US009802069B2

(12) United States Patent
Kosovski-Shahor

(10) Patent No.: US 9,802,069 B2
(45) Date of Patent: Oct. 31, 2017

(54) THROWABLE FIRE EXTINGUISHER

(71) Applicant: Koso Technologies Ltd., Modiin Ilit (IL)

(72) Inventor: Avi Kosovski-Shahor, Modiin Ilit (IL)

(73) Assignee: KOSO TECHNOLOGIES LTD., Modiin Ilit (IL)

( * ) Notice: Subject to any disclaimer, the term of this patent is extended or adjusted under 35 U.S.C. 154(b) by 0 days.

(21) Appl. No.: 14/898,114

(22) PCT Filed: May 16, 2014

(86) PCT No.: PCT/IL2014/050429
§ 371 (c)(1),
(2) Date: Dec. 11, 2015

(87) PCT Pub. No.: WO2014/203238
PCT Pub. Date: Dec. 24, 2014

(65) Prior Publication Data

US 2016/0136468 A1 May 19, 2016

Related U.S. Application Data

(60) Provisional application No. 61/881,002, filed on Sep. 23, 2013, provisional application No. 61/835,584, filed on Jun. 16, 2013.

(51) Int. Cl.

| | |
|---|---|
| ***A62C 35/00*** | (2006.01) |
| ***A62C 13/62*** | (2006.01) |
| ***A62C 35/10*** | (2006.01) |
| ***A62C 13/64*** | (2006.01) |
| ***A62C 35/08*** | (2006.01) |
| ***A62C 13/68*** | (2006.01) |
| ***A62C 13/76*** | (2006.01) |
| ***A62C 37/11*** | (2006.01) |
| *A62C 19/00* | (2006.01) |

(52) U.S. Cl.
CPC ..... *A62C 13/62* (2013.01); *A62C 13/64* (2013.01); *A62C 13/68* (2013.01); *A62C 13/76* (2013.01); *A62C 35/08* (2013.01); *A62C 35/10* (2013.01); *A62C 37/11* (2013.01); *A62C 19/00* (2013.01)

(58) Field of Classification Search
CPC ..... A62C 13/003; A62C 13/64; A62C 13/68; A62C 19/00; A62C 3/025; A62C 35/08; A62C 35/10
USPC ..... 169/26, 33–36, 30, 71–89
See application file for complete search history.

(56) References Cited

U.S. PATENT DOCUMENTS 2,166,277 A * 7/1939 Adams ..... A62C 13/003 116/106
2,218,855 A * 10/1940 Roessner ..... A62C 19/00 169/26
3,785,569 A * 1/1974 Helmrich ..... B65D 83/28 102/368

(Continued)

*Primary Examiner* — Alexander Valvis
(74) *Attorney, Agent, or Firm* — Graeser Associates International Inc; Dvorah Graeser

(57) ABSTRACT

There is provided a fire extinguisher comprising a fire extinguishing agent; a first mechanism configured to operate said fire extinguisher via a manual operation; a second mechanism configured to operate said fire extinguisher automatically; and wherein said fire extinguisher comprises at least one detector to detect the existence of a fire and cause the operation of said second mechanism.

9 Claims, 29 Drawing Sheets

(56) References Cited

U.S. PATENT DOCUMENTS

| | | | | | |
|---|---|---|---|---|---|
| 3,811,511 | A * | 5/1974 | McCulloch | A62C 35/08 | 169/28 |
| 4,159,744 | A * | 7/1979 | Monte | A62C 35/08 | 169/26 |
| 4,705,064 | A * | 11/1987 | Self | A62C 13/76 | 137/384 |
| 4,964,469 | A * | 10/1990 | Smith | A62C 3/025 | 102/488 |
| 5,063,998 | A * | 11/1991 | Quinn | A62C 2/04 | 169/58 |
| 6,742,599 | B1 * | 6/2004 | Nam | A62C 13/64 | 169/26 |
| 7,832,493 | B2 * | 11/2010 | Gross | A62C 5/006 | 102/261 |
| 2011/0056711 | A1 * | 3/2011 | Gross | A62C 5/006 | 169/46 |
| 2012/0037717 | A1 * | 2/2012 | Zakhmatov | A62C 3/0242 | 239/1 |
| 2013/0092402 | A1 * | 4/2013 | Al Thawad | A62C 3/02 | 169/19 |
| 2013/0186655 | A1 * | 7/2013 | Mauney | A62C 3/006 | 169/74 |

* cited by examiner

THROWABLE FIRE EXTINGUISHER

FIELD OF THE INVENTION

The present invention relates to the field of fire extinguishment and specifically to an apparatus for extinguishing a fire.

BACKGROUND OF THE INVENTION

Fire is the rapid oxidation of a material in the exothermic chemical process of combustion, releasing heat, light, and various reaction products.

Fires start when a flammable and/or a combustible material, in combination with a sufficient quantity of an oxidizer such as oxygen gas or another oxygen-rich compound (though non-oxygen oxidizers exist that can replace oxygen), is exposed to a source of heat or ambient temperature above the flash point for the fuel/oxidizer mix, and is able to sustain a rate of rapid oxidation that produces a chain reaction.

A fire extinguisher is an active fire protection device used to extinguish or control small fires, often in emergency situations, often being the first line of defense when a fire breaks out.

Typically, a fire extinguisher consists of a hand-held cylindrical pressure vessel containing an agent which can be discharged to extinguish a fire, whereas two main types of fire extinguishers are usually used: stored pressure and cartridge-operated.

In stored pressure units, the expellant is stored in the same chamber as the fire-extinguishing agent itself. Depending on the type of agent used, different propellants may be used. With dry chemical extinguishers, nitrogen is typically used, whereas water and foam extinguishers typically use air.

Cartridge-operated extinguishers contain the expellant gas in a separate cartridge that is punctured prior to discharge, exposing the propellant to the extinguishing agent. This type is not as common as the stored pressure units, and is used primarily in areas such as industrial facilities, where they receive higher-than-average use. They have the advantage of simple and prompt recharge, allowing an operator to discharge the extinguisher, recharge it, and return to the fire in a reasonable amount of time. Unlike stored pressure types, these extinguishers use compressed carbon dioxide instead of nitrogen, although nitrogen cartridges are used on low temperature (−60 rated) models. Cartridge operated extinguishers are available in dry chemical and dry powder types and also in water, wetting agent, foam, dry chemical and dry powder types.

SUMMARY OF THE INVENTION

In some demonstrative embodiments, there is provided a fire extinguisher (also referred to herein as "a fire extinguishing device") which may include a fire extinguishing agent including a first mechanism configured to operate the fire extinguishing apparatus in a manual operation and a second mechanism configured to operate the fire extinguishing apparatus automatically.

According to some demonstrative embodiments, the fire extinguisher may comprise a fire extinguishing agent, a first mechanism configured to operate said fire extinguisher via a manual operation; a second mechanism configured to operate said fire extinguisher automatically; and wherein said fire extinguisher may comprise at least one detector to detect the existence of a fire and cause the operation of said second mechanism.

In some demonstrative embodiments, the fire extinguisher may include a pressurized aerosol container which may include the fire extinguishing agent.

According to some embodiments, the first mechanism may include a nozzle configured to be pushed, wherein pushing the nozzle causes the fire extinguishing agent to be dispersed from the apparatus.

According to some embodiments, the fire extinguisher may include an apparatus including at least a first and second compartments, wherein said first compartment may include one or more detectors and the second compartment may include one or more automatic activation mechanisms configured to prevent the dispersion of the fire extinguishing agent from the fire extinguisher when the fire extinguisher is not operating automatically.

In some demonstrative embodiments, the first compartment may further include an operator.

According to some embodiments, the one or more automatic activation mechanisms may include a stopper configured to prevent the dispersion of the fire extinguishing agent from the fire extinguisher when the fire extinguisher is not operating automatically, a capsule configured to keep the stopper in place when the fire extinguisher is not operating automatically and a wire wrapped around the capsule.

According to some embodiments, the wire may be configured to break the capsule when the fire extinguisher is operated automatically.

According to some embodiments, the one or more automatic activation mechanisms may include a stopper configured to prevent the dispersion of the fire extinguishing agent from the fire extinguisher when the fire extinguisher is not operating automatically, a rod, which may be configured to keep the stopper in place when the fire extinguisher is not operating automatically, a spring, which may be configured to push the rod and release the stopper when the fire extinguisher is operating automatically.

According to some embodiments, the fire extinguisher may further include a string configured to keep the rod in place when the fire extinguisher is not operating automatically.

According to some embodiments, the fire extinguisher may further include a wire wrapped around the string, configured to heat and tear the string when the fire extinguisher is to be operated automatically.

According to other embodiments, the fire extinguisher may include a metal connector configured to keep the rod in place when the fire extinguisher is not operating automatically.

According to some embodiments, the fire extinguisher may further include a wire wrapped around said metal connector, configured to heat and break said metal connector when said fire extinguisher is operating automatically.

According to some embodiments the one or more detectors may include a mechanical or electrical detector configured to sense the elevation of temperature beyond a predetermined temperature.

According to some embodiments, the predetermined temperature may be 65° C. or above, i.e., at least 65° C.

According to some embodiments, the predetermined temperature may be 130° C. or above, i.e., at least 130° C.

According to some demonstrative embodiments, there is provided a fire extinguisher comprising a fire extinguishing agent including a pressurized aerosol container having a shape which is not a ball shape.

BRIEF DESCRIPTION OF THE DRAWINGS

The present invention will become fully understood from the detailed description given herein below and the accompanying drawings, which are given by way of illustration and example only, and thus not limiting in any way, wherein.

DETAILED DESCRIPTION OF THE INVENTION

Figure 1:
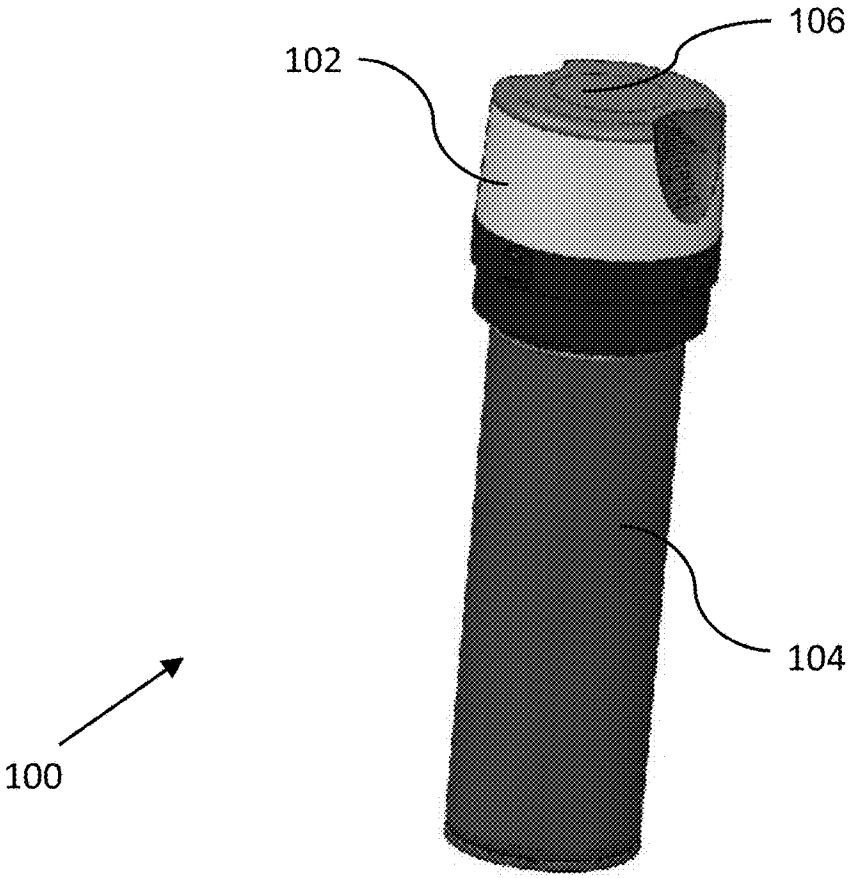
FIG. 1 illustrates an isometric view of a fire extinguisher in accordance with some demonstrative embodiments described herein.

In some demonstrative embodiments, there is provided a fire extinguisher for extinguishing a fire, wherein the fire extinguisher is configured to operate in at least two alternative modes, a first fire extinguishing mode (also referred to herein as "first mode of operation", "first operating mode" or "manual operation") and a second fire extinguishing mode (also referred to herein as "second mode of operation", "second operating mode" or "automatic operation").

In some demonstrative embodiments, the fire extinguisher may include a fire extinguishing agent, wherein operation of the fire extinguisher may include extrusion and/or spraying of the fire extinguishing agent onto a fire.

According to some demonstrative embodiments, the term "fire extinguishing agent" may refer to any suitable agent capable of extinguishing and/or diminishing a fire, including, for example, Monoammonium phosphate (also known as "tri-class", "multipurpose" or "ABC" dry chemical), Sodium bicarbonate, Potassium bicarbonate (also known as "Purple-K"), Potassium bicarbonate & Urea Complex (also known as "Monnex/Powerex"), Potassium chloride (also known as Super-K), Foam-Compatible, which is a sodium bicarbonate (BC) based dry chemical, variations of sodium bicarbonate such as MET-L-KYL/PYROKYL; Foams, including, for example, AFFF (aqueous film forming foam), AR-AFFF (Alcohol-resistant aqueous film forming foams), FFFP (film forming fluoroprotein), CAFS (compressed air foam system), Arctic Fire, FireAde; Water based agents which cool burning materials, such as APW (Air pressurized water) and Water Mist; Wet chemicals and water additives such as Wet Chemical (potassium acetate, carbonate, or citrate), Wetting Agents, Antifreeze Chemicals such as distilled water with some kind of alcohol (for example, Methanol, Ethylene glycol, Propylene glycol, Glycerol and the like); Clean agents and carbon dioxide such as Halon (such as Halon 1211 and Halon 1301), Halocarbon replacements (such as CFC Blend B-Halotron I®, American Pacific Corporation, HFC-227ea-FM-200®, Great Lakes Chemicals Corporation, and HFC-236fa-FE-36®, DuPont), $CO_2$, Mixtures of inert gases, including Inergen and Argonite, fluoronated ketones such as Novec 1230 fluid (also known as "dry water" or Saffire fluid), solid potassium and other chemicals referred to as Aerosol Forming Compounds (AFC), Agents intended to extinguish fires involving combustible metals (known as Class D agents) such as Sodium chloride (such as Super-D, Met-L-X or METAL.FIR-E.XTNGSHR), Copper based agents (such Copper Powder Navy 125S), Graphite-based agents (such as G-Plus, G-1, Lith-X, Pyromet or METAL.FIRE.XTNGSHR), Sodium carbonate-based (Na-X) agents, burning titanium and magnesium and other suitable types of water based suppressants; and the like.

According to some demonstrative embodiments, the fire extinguishing agent may be comprised of a combination of two or more agents as described above. According to some preferred embodiments, the fire extinguishing agent may include a combination of two or more agents from the group including Mono-sodium (e.g., Elinex-ABC40®), $K_2CO_3$, Sodium Bicarbonate, Ammonium Phosphate. According to even more preferred embodiments, the fire extinguishing agent of the present invention is comprised of a combination of Mono-sodium (e.g., Elinex-ABC40®), $K_2CO_3$, Sodium Bicarbonate, Ammonium Phosphate (also referred to herein as Elinex-ABC40-(CAAP)). According to some embodiments, Elinex-ABC40-(CAAP) is designed to extinguish the fire and/or prevent the re-eruption of fire. The Ammonium Phosphate in the Elinex-ABC40-(CAAP) is effective in the extinguishment of flammable liquids, such as tar, oil, diesel fuel, deep fryer liquids and the like.

According to some embodiments, the unique combination of the agents of Elinex-ABC40-(CAAP) is designed to enable the extinguishment of a fire with minimal collateral damage to the nearby environment. The ingredients of Elinex-ABC40-(CAAP) possess minimal corrosive properties and are insulated in order to enhance the safety in cases wherein electricity is involved.

According to some embodiments, Elinex-ABC40-(CAAP) may be in the form of a powder, e.g., including micro-particles in a size range between 25-40 Microns. According to some embodiments the micro-particles may include a large surface area, in comparison to other forms of fire extinguishing agents known in the art, and the dispersion of the micro-particles may enable the effective extingui9shment of a fire, e.g., to the essentially complete capture of the mass, liquids and/or gases which are involved in the combustion or burning process. According to some embodiments, the particles of the powder may come in contact with a burning element, dissolve and cover the burning element, thereby creating a non-permeable layer which prevents the transfer of oxygen to burning element.

According to some demonstrative embodiments, the Elinex-ABC40-(CAAP) powder may be designed to extinguish a fire related to the burning of solid elements, e.g., wood, flammable liquids and fire extinguishment in areas involving electricity.

According to some demonstrative embodiments, the fire extinguishing agent of the present invention may be combined with a foam, e.g., without diminishing from the effective properties of the powder described hereinabove.

According to some demonstrative embodiments, the fire extinguisher of the present invention may include an aerosol container, e.g., in a volume of 1000 ml and an internal pressure of 18 bar, including the fire extinguishing powder, e.g., in a net volume of 750 ml, whereas the total weight of the apparatus and powder is less than 1.5 kg.

According to some embodiments, the container is a pressurized aerosol container having a suitable shape including: a cylinder, a cone and/or any other spherical shape.

According to some demonstrative embodiments, the container is preferably not in the shape of a ball. Ball shaped containers possess several disadvantages including, the inability to properly create a pressurized container. In a cylinder shaped container, the pressurized gas has a specific direction pushing the fire extinguishing agent to a predetermined exit point.

According to some embodiments, 750 ml of Elinex-ABC40-(CAAP) are equivalent to 1500 ml of other Mono-sodium based fire extinguishing agents, in terms of fire extinguishing capabilities.

In some demonstrative embodiments, as mentioned hereinabove, the fire extinguisher may include two operating modes (also referred to herein as "fire extinguishing modes"), e.g., a first mode and a second mode.

According to some demonstrative embodiments, the first fire extinguishing mode may include a manual operation of the fire extinguishing apparatus. For example, a user operating the fire extinguisher of the present invention may press a nozzle and spray the fire extinguishing agent(s) on a fire.

According to some demonstrative embodiments, the fire extinguisher may include an aerosol container, wherein a user of the fire extinguisher may push a nozzle. According to some embodiments, the fire extinguisher of the present invention may include a nozzle enabling spraying of the fire extinguishing agent up to a range of 5-6 meters, e.g., enabling an effective coverage and extinguishment of the fire, in comparison to ordinary coverage range of fire extinguishers known in the art which usually cover a spraying range of no more than 2-3 meters.

According to some demonstrative embodiments, the second fire extinguishing mode may include an automatic operation of the fire extinguisher. According to some embodiments, the automatic operation may include one or more mechanisms, e.g., electronic mechanisms, which detect the existence of fire in the whereabouts of the fire extinguishing apparatus, e.g., according to a certain temperature or higher, and automatically dispense the fire extinguishing agent(s) on the fire.

For example, a user operating the fire extinguisher of the present invention may detect a fire and throw the fire extinguisher into the fire. The fire extinguisher may subsequently automatically dispense the fire extinguishing agent(s) on the fire.

In some demonstrative embodiments, throwing the fire extinguisher into the fire may cause an automatic, multi-point spreading of the fire extinguishing agent(s) on the fire.

According to some embodiments, as explained in detail below, the fire extinguisher may include a top cover having one or more passage holes, wherein upon automatic operation of the fire extinguisher, the fire extinguishing agent(s) is automatically sprayed and/or extruded through the one or more passage holes. According to some demonstrative embodiments, the one or more passage holes may be positioned in a suitable arrangement to allow the even and/or wide ranged, dispersion of the fire extinguishing agent(s) from the fire extinguisher, e.g., thereby enabling the rapid extinguishment and/or diminishment of the fire. According to some demonstrative embodiments, due to the simplicity of operation, the fire extinguisher may be very useful for both private individuals and rescue forces, e.g., fire fighters, police officers and other rescue teams. Due to the relatively light weight of the extinguisher, the fire extinguisher may be carried around easily and/or placed on vehicles and motorcycles to enable the rapid response to a breaking fire.

According to some demonstrative embodiments, there is provided a fire extinguisher for extinguishing a fire, wherein the fire extinguisher is comprised of a container made of any suitable package, including for example, and suitable metal can or plastic bottle, designed to dispense the fire extinguishing agent(s) as a gas, mist, powder and/or foam.

According to some demonstrative embodiments, as described in detail below with respect to the drawings, the upper portion of the container may include an extension to enable the attachment of a cover. According to some embodiments, the cover may include one or more elements configured to enable the operation of the fire extinguishing apparatus in the first or second mode of operation.

According to some demonstrative embodiments, the fire extinguisher of the present invention may be positioned at a predetermined location within a room or a closed space, for example, attached to a wall (also referred to herein as a "Sprinkler-like" operation). According to these embodiments, if a fire breaks out in the room or the closed space the fire extinguisher may automatically operate upon the detection of the fire, as explained in detail below.

According to some demonstrative embodiments there is provided an apparatus configured to be attached to a fire extinguisher, wherein the device is configured to enable the fire extinguisher to act in an automatic mode or in a manual mode, for example, as explained in detail below with regard to the drawings.

According to some demonstrative embodiments, the fire extinguisher of the present invention may have one or more safety mechanism, for example, configured to prevent the fire extinguisher from automatically operating when a fire and/or smoke is not detected and/or configured to save battery life. According to some embodiments, the safety mechanism may enable the fire extinguisher to be conveyed in various conditions (changing and/or high temperatures, humidity and the like) and only become active after the fire extinguisher is purchased by a user and the safety mechanism is deactivated (for example, a safety catch may be pulled of the fire extinguisher to cause the fire extinguisher to be at a stand-by mode, i.e., activating a detector of the fire extinguisher to detect a fire and/or smoke and/or high temperature or any combination thereof).

As is known in the art, a common fire extinguisher is operated manually when a user of the extinguisher squeezes a lever causing a fire extinguishing agent or material encompassed within the extinguisher to be released onto a fire. According to some demonstrative embodiments, the apparatus of the present invention may be attached to any common fire extinguisher and enable the fire extinguisher to operate in the first operating mode or the second operating mode.

According to some demonstrative embodiments, the apparatus of the present invention may include one or more detectors, e.g., to detect the existence of a fire. According to some embodiments, the detector may be any suitable electronic or mechanical device, configured to identify the existence of any suitable indicator of a fire, including for example, elevated temperature, smoke, elevated $CO_2$ levels and the like. For example, the detector may be selected from a group including: temperature detectors, e.g., configured to detect the elevation of temperature such as EN54-5; flame detectors, e.g., optical type detectors such as Ultraviolet flame detectors, Near infrared (IR) Array flame detectors, infrared flame detectors, UV and IR flame detectors, IR/IR flame detectors, IR3 flame detectors; Ionization current flame detectors; Thermocouple flame detectors; smoke detectors, such as Air-sampling detectors, Carbon monoxide and/or carbon dioxide detectors, Ionization detectors, Photoelectric detectors, Beam operated detectors, Aspirating detectors, Laser detectors, EN54-7 detectors and the like.

According to some demonstrative embodiments of the present invention, there is provided an apparatus configured to be installed onto a fire extinguisher and enable the automatic detection of a fire and subsequently cause the automatic operation of the fire extinguisher.

According to some demonstrative embodiments, there is provided an apparatus for a fire extinguisher, wherein the fire extinguisher comprises a nozzle and a body. According to some embodiments, the apparatus may include at least one detector to enable the automatic detection of a fire; at least one mechanism to cause the automatic operation of said fire extinguisher upon detection of said fire; and wherein said apparatus may be positioned between nozzle and said body of said fire extinguisher, e.g., as described in detail with regard to the drawings below.

According to some embodiments, an fire extinguisher comprising the apparatus of the present invention may be operated in at least one of three ways:

1. Automatic "Sprinkler like" operation—According to some embodiments, a fire extinguisher comprising the apparatus of the present invention may be placed upon a wall, wherein the apparatus essentially constantly measures one or more environmental parameters, e.g., environmental temperature, environmental level of Carbon Dioxide and/or Carbon Monoxide, existence of smoke and the like, to detect the existence of a fire.
   According to some embodiments, upon detection of a fire the apparatus will cause the automatic operation of the fire extinguisher, causing the fire extinguishing agent to be dispersed onto the fire.
2. "Fire extinguishing grenade" operation—According to some embodiments, if a user of the fire extinguisher identifies a fire, the user may throw the fire extinguisher into the fire, thereby causing the apparatus of the present invention to detect the existence of the fire and cause the automatic operation of the fire extinguisher.
3. Manual operation—According to some embodiments, the apparatus of the present invention does not prevent the user of the fire extinguisher to use the fire extinguisher manually, e.g., by squeezing the operation handle of the fire extinguisher thereby causing the fire extinguishing agent to be dispersed.

According to some demonstrative embodiments, the apparatus of the present invention may include one or more safety mechanisms as part of the "Fire extinguishing grenade" operation (also referred to herein as "grenade safety").

According to these embodiments, a user of the apparatus of the present invention may pull out a safety to activate a timed operation of the apparatus. In some embodiments, the safety is configured to close an electrical circuit, maintaining the apparatus in a standby mode, e.g., ready to operate if the apparatus is proximate to a source of fire and/or heat. According to some embodiments, when the safety is pulled off the apparatus, the electrical circuit is opened, signaling the operation of a timer, e.g., a 10 second countdown timer, wherein when the timer finishes the countdown the apparatus is activated, e.g., depleting the fire extinguishing agent.

According to some embodiments, the apparatus may include a beeper configured to beep when the timer is activated, e.g., making a beeping sound which increases in intensity as the countdown progresses. The beeping sound may alert the user of the apparatus that the device is about to operate and accordingly, the user should throw the device without delay. According to some preferred embodiments, when a user of the apparatus of the present invention detects a fire, the user may pull out the grenade safety and hear the beeping sound, and accordingly throw the apparatus to the fire, ensuring the activation of the apparatus.

According to some embodiments, when the fire extinguisher including the apparatus is thrown to a fire it may potentially land in a position which will deny or defer the activation of the apparatus, for example, if the apparatus is thrown close to the fire but not close enough for the one or more detectors to detect the fire and/or if the apparatus is thrown to a place which may include one or more obstacles which may prevent the detection of the fire by the apparatus. According to some embodiments, one of the purposes of the grenade safety is to ensure the activation of the apparatus even in cases in which the apparatus may not immediately be activated.

According to some demonstrative embodiments, there is provided a method of putting out a fire including using a fire extinguisher including the apparatus of the present invention in at least one of the following ways: a manual operation, wherein the user of the fire extinguisher uses the fire extinguisher manually, e.g., by squeezing the operation handle of the fire extinguisher thereby causing the fire extinguishing agent to be dispersed from the fire extinguisher;

A fire extinguishing grenade operation, wherein if a user of the fire extinguisher identifies a fire, the user may throw the fire extinguisher into the fire, thereby causing the apparatus of the present invention to detect the existence of the fire and cause the automatic operation of the fire extinguisher;

an automatic "Sprinkler like" operation wherein upon detection of a fire the apparatus will cause the automatic operation of the fire extinguisher. According to some demonstrative embodiments, when operated as a fire extinguishing grenade operation the method may include pulling out a grenade safety, wherein pulling out the safety causes the operation of a countdown timer, e.g., a 10 second timer, and consecutively the operation of the fire extinguisher.

According to some demonstrative embodiments of the present invention, there is provided a method of extinguishing a fire by throwing a fire extinguisher into the fire, wherein the fire extinguisher may include an apparatus comprising at least one detector to detect the existence of a fire and to cause the automatic operation of the fire extinguisher.

According to some demonstrative embodiments of the present invention, there is provided a method of extinguishing a fire by operating a fire extinguisher in a "Sprinkler-like" operation, wherein the fire extinguisher may include an apparatus comprising at least one detector to detect the existence of a fire and to cause the automatic operation of the fire extinguisher.

According to some demonstrative embodiments, there is provided a use of an apparatus of the present invention for putting out a fire, wherein the use includes at least one of a:

a manual operation, wherein the user of the fire extinguisher uses the fire extinguisher manually, e.g., by squeezing the operation handle of the fire extinguisher thereby causing the fire extinguishing agent to be dispersed from the fire extinguisher;

a fire extinguishing grenade operation, wherein if a user of the fire extinguisher identifies a fire, the user may throw the fire extinguisher into the fire, thereby causing the apparatus of the present invention to detect the existence of the fire and cause the automatic operation of the fire extinguisher;

an automatic "Sprinkler like" operation wherein upon detection of a fire the apparatus will cause the automatic operation of the fire extinguisher. According to some demonstrative embodiments, these optional operation modes may enable a highly effective protection mechanism against fires, wherein the fire extinguisher may either be used by a user, or operated automatically when a fire breaks out.

According to some demonstrative embodiments, the fire extinguisher of the present invention may include one or more notification systems. According to some demonstrative embodiments, the notification systems may include one or more components to notify of at least one of the following: operation of the fire extinguisher (whether automatic or manual), depletion of the gas of the fire extinguishing agent, expiry of the fire extinguishing agent, reduction in gas pressure and/or any other malfunction and/or activity of the fire extinguisher of the present invention.

The one or more notification systems may notify a user and/or a group of users via any suitable means, including for example, sms and/or text messages, e-mail notifications, beeping, alarms and the like.

Reference is now made to FIG. 1. which illustrates an isometric view of a fire extinguisher 100 in accordance with some demonstrative embodiments described herein.

As shown in FIG. 1, fire extinguisher 100 may include a body 104, which may be an aerosol container containing a fire extinguishing agent(s) and a cap 102. According to some embodiments, as shown in FIG. 1 cap 102 may have a central button 106. When a user pushes button 106 pressure is operated on an inner nozzle (not shown in the figure) and the fire extinguishing agent(s) is dispensed.

Figure 2:
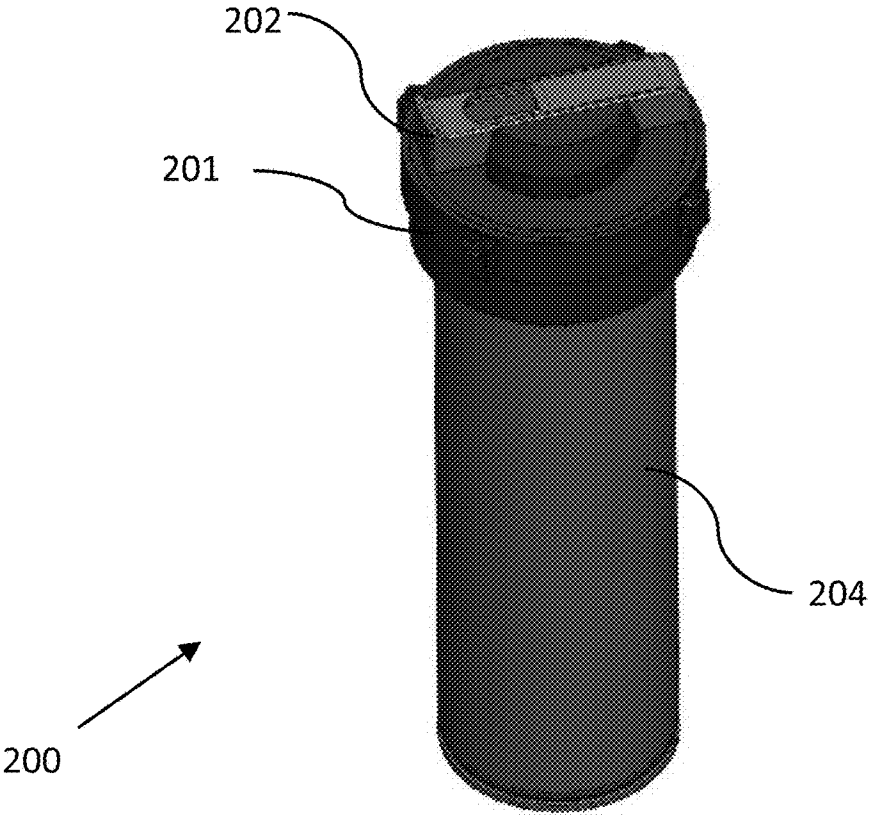
FIG. 2 illustrates an isometric view of a fire extinguisher in accordance with some demonstrative embodiments described herein.

Reference is now made to FIG. 2. which illustrates an isometric view of a fire extinguisher 200 in accordance with some demonstrative embodiments described herein.

As shown in FIG. 2, fire extinguisher 200 may include a body 204, which may be an aerosol container containing a fire extinguishing agent(s) a and cap 201. According to some embodiments, as shown in FIG. 2 cap 201 may have a foldable lever 202 in a closed position. According to some demonstrative embodiments, foldable lever 202 may be extended open (as shown for example in FIG. 3) and operated (as per the first operating mode) to dispense the fire extinguishing agent(s) onto a fire.

Figure 3:
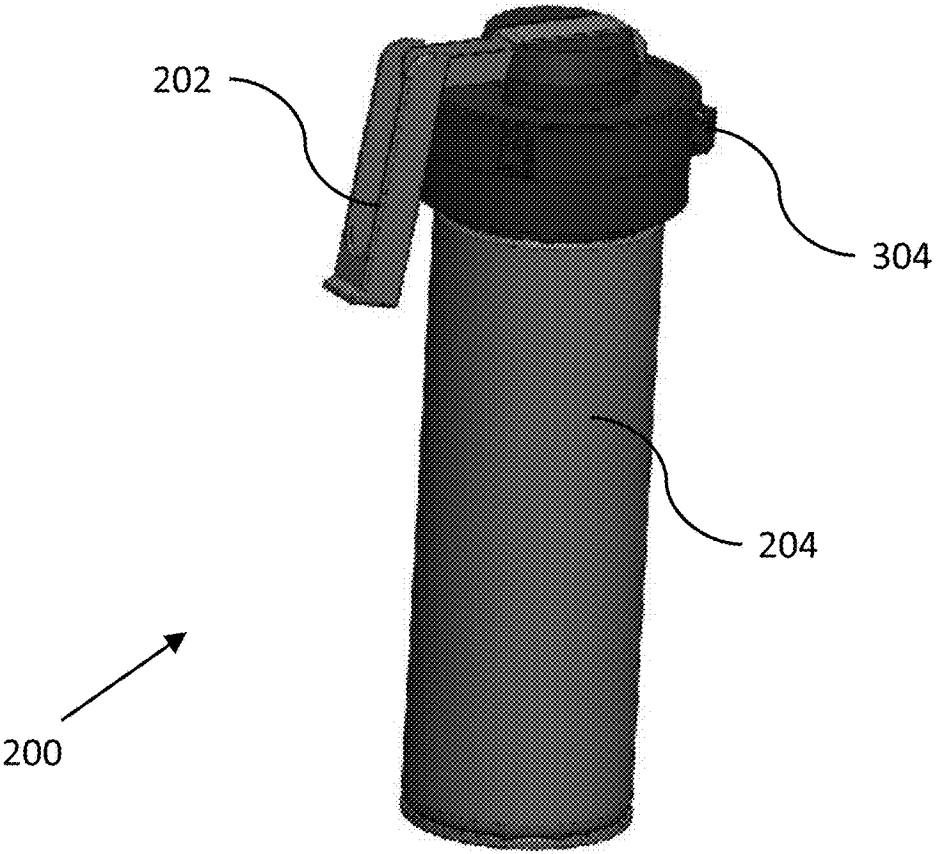
FIG. 3 illustrates an isometric view of the fire extinguisher of FIG. 2 in accordance with some demonstrative embodiments described herein.

Reference is now made to FIG. 3. which illustrates an isometric view of fire extinguisher 200 of FIG. 2 in accordance with some demonstrative embodiments described herein.

As shown in FIG. 3, fire extinguisher 200 may include a body 204, which may be an aerosol container containing a fire extinguishing agent(s) and foldable lever 202 in an extended open position. Lever 202 may be squeezed and operated (as per the first operating mode) to dispense the fire extinguishing agent(s) onto a fire.

As shown in FIG. 3, fire extinguisher 200 may include one or more dispensing holes 304, configured to dispense the fire extinguishing agent(s) onto a fire when fire extinguisher 200 is operated in the second operating mode, i.e., in an automatic mode.

According to some embodiments, when fire extinguisher 200 is placed in a fire, e.g., thrown into a fire, one or more mechanisms (not shown in the figure) detect the presence of a fire and fire extinguisher 200 automatically dispenses the fire extinguishing agent(s) via the one or more dispensing holes 304.

Figure 4:
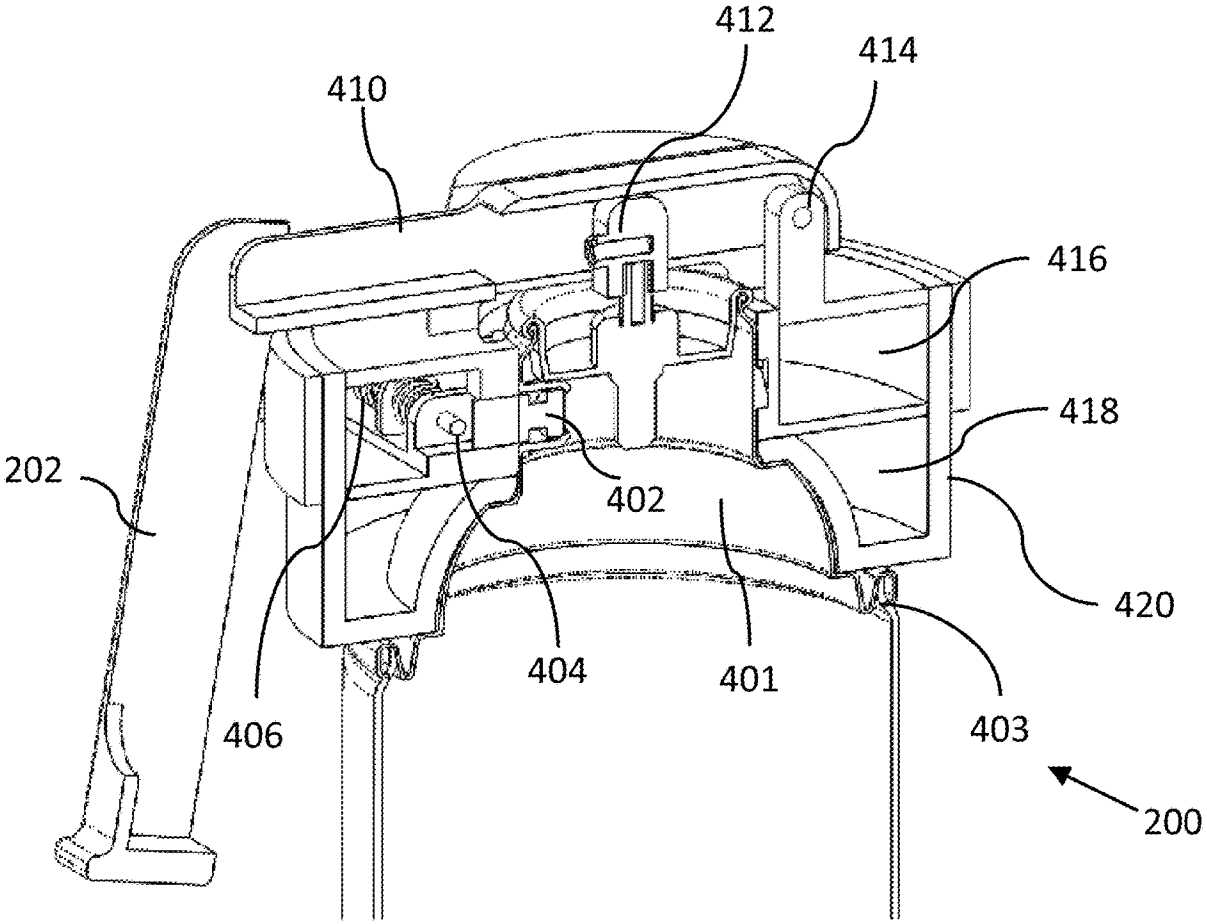
FIG. 4 is a schematic cross section view of the top portion of the fire extinguisher of FIG. 3, in accordance with some demonstrative embodiments described herein.

Reference is now made to FIG. 4. which illustrates a schematic cross section view of the top portion of fire extinguisher 200 of FIG. 2 in accordance with some demonstrative embodiments described herein.

As show in FIG. 4, fire extinguisher 200 includes an extension 401, which may be made of metal or plastic. On top of extension 401 there is positioned cover 420. According to some embodiments, extension 401 may be connected to the body of apparatus 200 via pressure connection and folding of the edges of extension 401, as shown in element 403. According to some demonstrative embodiments, extension 401 may be connected to the body of fire extinguisher 200 via any suitable method known in the art including, for example, by welding, gluing and the like.

According to some embodiments, extension 401 may be at a length of between 30-90 mm, preferably, between 55-75 mm, most preferably 65 mm. According to some embodiments, extension 401 may be at a length of between 30-90 mm, preferably, between 55-75 mm, most preferably 65 mm. According to some embodiments, extension 401 may have an inner diameter of between 70-110 mm, preferably between 80-100 mm, most preferably 90 mm.

According to some embodiments, extension 401 may be positioned on top of any standard container, to provide for a fire extinguisher 200 of the present invention.

As shown in FIG. 4, lever 202 is connected to element 410 which may be connected to cover 420 via pinning axis 414. According to some embodiments, when fire extinguisher 200 is operated via the first operation mode, i.e., manual operating mode, a user of fire extinguisher 200 squeezes lever 202 causing element 410 to press down on nozzle 412. As in any aerosol container pressing down in the nozzle, e.g., nozzle 412, causes the dispersion of the material contained in the container. According to this example, pushing down on nozzle 412 causes the dispersion of the fire extinguishing agent contained in fire extinguisher 200.

According to some embodiments, element 410 includes a spraying path, e.g., a tunnel, enabling the fire extinguishing agent to be sprayed out of fire extinguisher 200 in an even and/or concentrated manner. According to some embodiments, the tunnel of element 410 may enable the user of fire extinguisher 200 to spray the fire extinguishing agent to a distance. According to some demonstrative embodiments of the present invention, fire extinguisher 200 may include one or more mechanisms to enable the automatic operation of fire extinguisher 200, i.e., the automatic dispersion of the fire extinguishing agent when fire extinguisher 200 is located in or at a proximity of a fire.

According to some embodiments, the mechanisms may be positioned at one or more compartments of cover 420, for example, at compartments 416 and 418.

According to some embodiments, compartment 418 may include one or more electrical or mechanical detectors (not shown in the figure), e.g., sensors such as heat and/or smoke sensors, configured to detect a fire or smoke in proximity to fire extinguisher 200, e.g., in a distance less than 10 meters, preferably less than 5 meters, most preferably less than 3 meters. According to some embodiments, compartment 416 may include one or more standby mechanisms, configured to cause the dispersion of the fire extinguishing agent from fire extinguisher 200, e.g., when a fire or smoke is detected in proximity to fire extinguisher 200.

According to some embodiments, compartment 416 is positioned on top of compartment 418 (as shown in FIG. 4). According to other embodiments, compartment 416 is positioned below compartment 418, as shown for example, in FIG. 7.

According to yet one embodiments of the present invention, the standby mechanism may include a stopper 402. As the fire extinguishing agent is kept under pressure, e.g., 18 bar pressure which pushes the agent out of fire extinguisher 200, stopper 402 is preventing from the fire extinguishing agent to be dispersed out of fire extinguisher 200 through one or more holes 304 (not shown in FIG. 4). According to some embodiments, due to the pressure inside the container of fire extinguisher 200, the fire extinguishing agent may be dispersed to a range of about 2-6 meters. In some embodiments, stopper 402 is kept in place, i.e., preventing the fire extinguishing agent from being dispersed out of fire extinguisher 200, due to rod 404. When fire extinguisher 200 in not operating in the second mode of operation, spring 406 pushes rod 404 to maintain stopper 402 in place. According to some embodiments, when the detectors detect a fire, an electrical signal is transferred to an operator (not shown in the figure), which in turn causes spring 406 to release rod 404 from its position, thereby causing stopper 402 to come loose and subsequently causing the fire extinguishing agent to be dispersed from fire extinguisher 200 (e.g., via one or more holes 304 of FIG. 3, not shown in FIG. 4).

Figure 5:
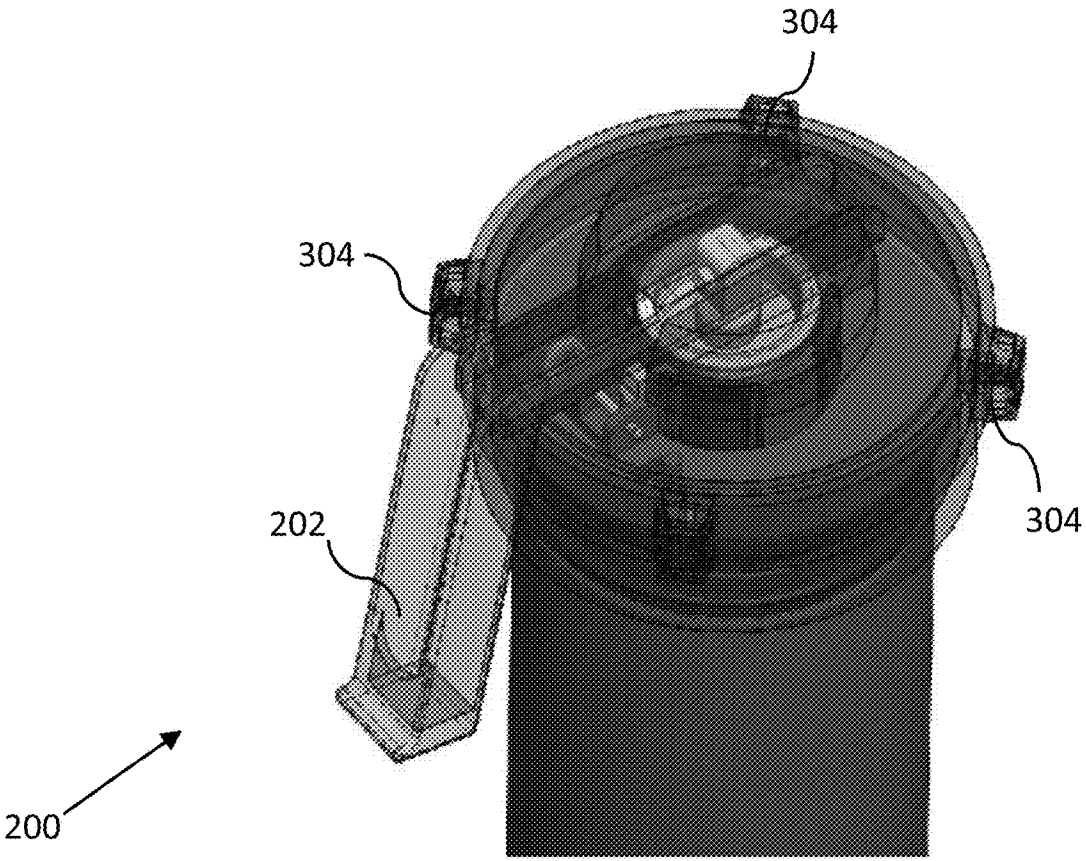
FIG. 5 illustrates an isometric view of the fire extinguisher of FIG. 2 in accordance with some demonstrative embodiments described herein.

Reference is now made to FIG. 5. which illustrates an isometric view of the fire extinguishing fire extinguisher 200 of FIG. 2 in accordance with some demonstrative embodiments described herein.

As shown in FIG. 5, fire extinguisher 200 includes lever 202, to operate fire extinguisher 200 in the first operation mode. When fire extinguisher 200 is operated in the second mode of operation, the fire extinguishing agent is dispersed through holes 304.

Figure 6:
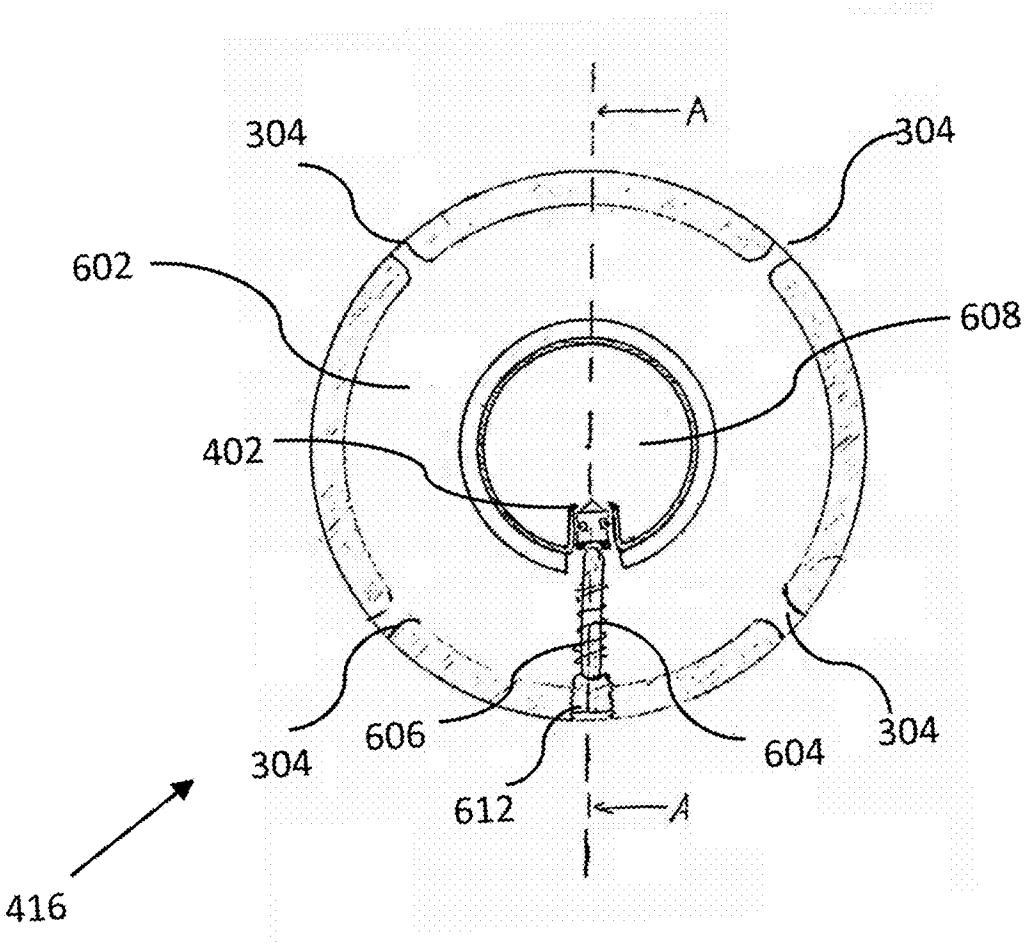
FIG. 6 is a schematic cross section top plane view of a first section of the top portion of the fire extinguisher of FIG. 2, in accordance with some demonstrative embodiments described herein.

Reference is now made to FIG. 6. which illustrates a schematic cross section top plane view of a first compartment 416 of FIG. 4 of fire extinguisher 200 of FIG. 2 in accordance with some demonstrative embodiments described herein.

As shown in FIG. 6, compartment 416 includes at least one hole 304. When fire extinguisher 200 operates in the second mode of operation, the fire extinguishing agent fills cavity 602 and is further dispersed through holes 304.

Cavity 608 includes the fire extinguishing agent, which is kept under high pressure within fire extinguisher 200, e.g., under the pressure of 18 Bar. When fire extinguisher 200 is not operated in the second mode of operation, stopper 402 prevents the fire extinguishing agent from being dispersed out of fire extinguisher 200.

According to some embodiments, stopper 402 is kept in place due to capsule 604 which is positioned on base 612 configured to keep capsule 604 at a specific, i.e., fixed or immobilized, position.

According to some embodiments, capsule 604 may include any suitable heat-sensitive glass bulb or a two-part metal link held together with fusible alloy such as Wood's metal and/or other alloys with similar compositions. The glass bulb or link applies pressure to stopper 402 which acts as a plug and prevents the fire extinguisher agent from flowing out fire extinguisher 200 until the ambient temperature around fire extinguisher 200 reaches a predetermined activation temperature.

According to some embodiments, the pre-determined activation temperature may be set according to the expected storage of fire extinguisher 200. For example, if fire extinguisher 200 is designed to be kept indoors, the predetermined activation temperature may be above 65° C. According to other embodiments of the present invention, if fire extinguisher 200 is designed to be kept in a car, the predetermined activation temperature may be above 130° C., e.g., because the temperature inside a car kept in the sun may reach extremely high levels.

According to some embodiments, capsule 604 can break as a result of the thermal expansion of a liquid inside the bulb. The time it takes before a bulb breaks is dependent on the temperature. Below the activation temperature, capsule 604 does not break, and above the design temperature, it takes less time for higher temperatures. The response time is expressed as a response time index (RTI), which typically has values between 35 and 250 m1/2s1/2, According to other embodiments, capsule 604 is covered or wrapped in wire 606. When fire extinguisher 200 is operated in the second mode of operation, wire 606 causes capsule 604 to break, e.g., via transferring heat to capsule 604, thereby releasing stopper 402 from its place and dispersing the fire extinguishing agent into cavity 602, and out of fire extinguisher 200 via holes 304.

Figure 7:
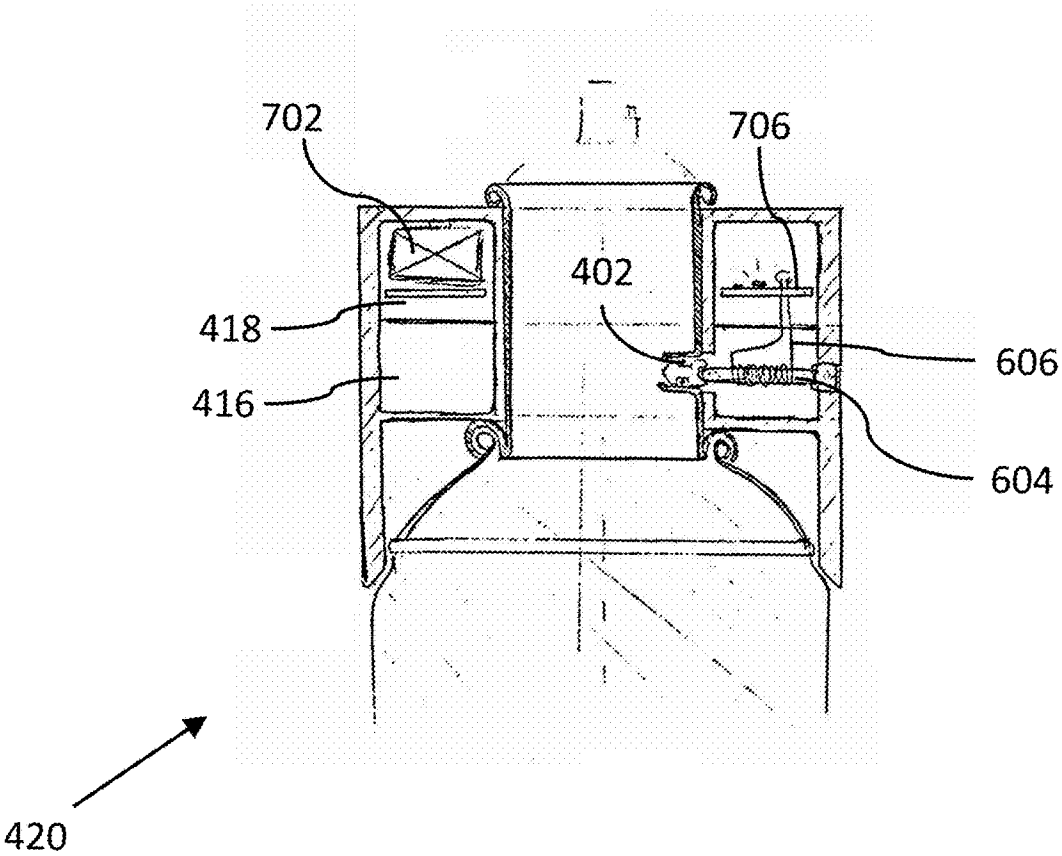
FIG. 7 is a schematic cross section side plane view of the top portion of the fire extinguishing device of FIG. 2, in accordance with some demonstrative embodiments described herein.

Reference is now made to FIG. 7. which illustrates a schematic cross section side plane view of cover 420 of FIG. 4 of the fire extinguishing fire extinguisher 200 of FIG. 2 in accordance with some demonstrative embodiments described herein.

As shown in FIG. 7, cover 420 includes compartment 416, being positioned below compartment 418. Cover 420 includes stopper 402 of FIG. 2, preventing from the fire extinguishing agent of apparatus 200 to be dispersed out of fire extinguisher 200 when fire extinguisher 200 is not in the second operating mode.

According to some demonstrative embodiments, cover 420 includes a stopping element, configured to keep stopper 402 in place when fire extinguisher 200 is not in the second operating mode. As shown in FIG. 7, the stopping mechanism according to some embodiments may be capsule 604 of FIG. 6, wrapped in wire 606 of FIG. 6.

According to some embodiments, detector 702 may detect a fire proximal to fire extinguisher 200, e.g., due to elevated temperatures, and subsequently send an electrical signal to operator 706.

According to some embodiments, detector 702 does not send a signal to operator 706 until the ambient temperature around fire extinguisher 200 reaches a predetermined activation temperature.

According to some embodiments, the pre-determined activation temperature may be set according to the expected storage of fire extinguisher 200. For example, if fire extinguisher 200 is designed to be kept indoors, the predetermined activation temperature may be above 65° C. According to other embodiments of the present invention, if fire extinguisher 200 is designed to be kept in a car, the predetermined activation temperature may be above 130° C., e.g., because the temperature inside a car kept in the sun may reach extremely high levels.

Figure 8:
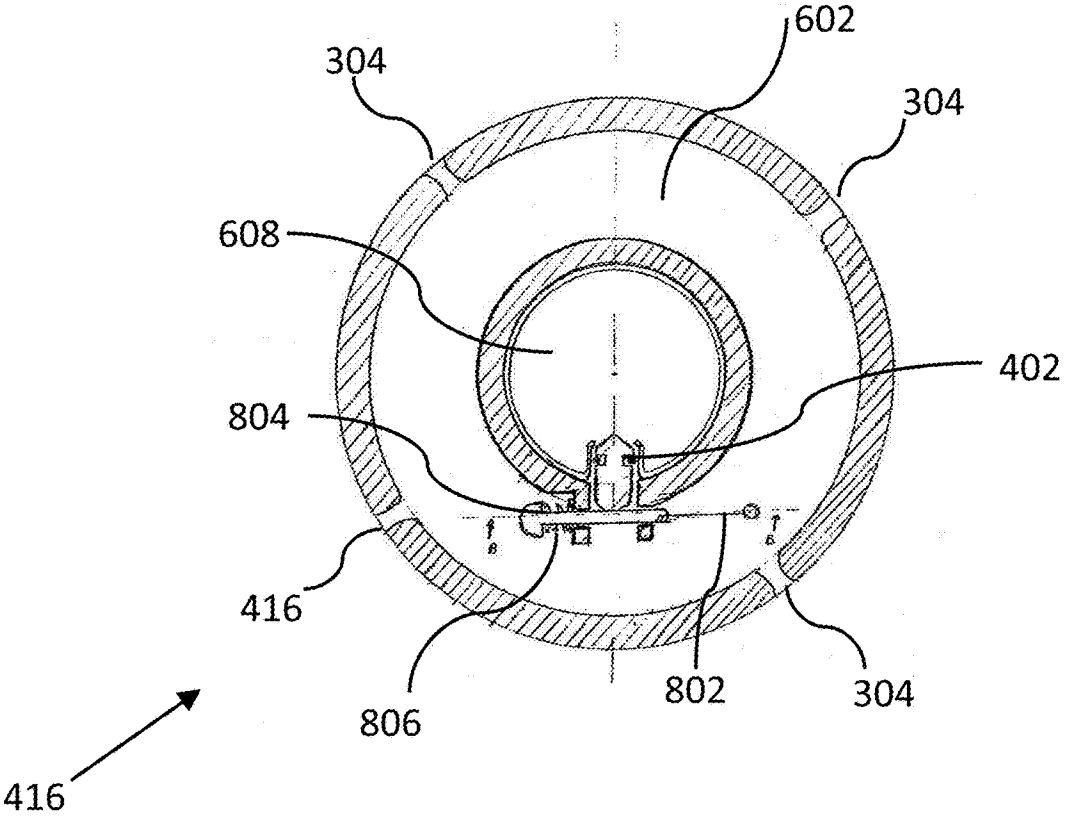
FIG. 8 is a schematic cross section top plane view of a first section of the top portion of the fire extinguishing device of FIG. 2, in accordance with some demonstrative embodiments described herein.

When a fire is detected by detector 702 an electrical signal is sent to operator 706, which heats wire 606 and breaks capsule 604 to break loose stopper 402 and release the fire extinguishing agent of apparatus 200. Reference is now made to FIG. 8. which illustrates a schematic cross section top plane view of first compartment 416 of FIG. 4 of the fire extinguishing fire extinguisher 200 of FIG. 2 in accordance with some demonstrative embodiments described herein.

As shown in FIG. 8, compartment 416 includes at least one hole 304. When fire extinguisher 200 operates in the second mode of operation, the fire extinguishing agent fills cavity 602 and is further dispersed out of fire extinguisher 200 through holes 304.

Cavity 608 includes the fire extinguishing agent, which is kept under high pressure within fire extinguisher 200, e.g., under 18 Bar. When fire extinguisher 200 is not operated in the second mode of operation, stopper 402 prevents the fire extinguishing agent from being dispersed out of fire extinguisher 200.

According to some embodiments, stopper 402 is kept in place due to pin 804 (also referred to herein as a "rod"). Pin 804 is wrapped by spring 806 which is kept in a tense position as long as fire extinguisher 200 is not in the second operating mode. According to some embodiments, despite the pressure of spring 806, pin 804 is kept in place since it is tied by string 802, and accordingly stopper 402 is kept in place.

Figure 9:
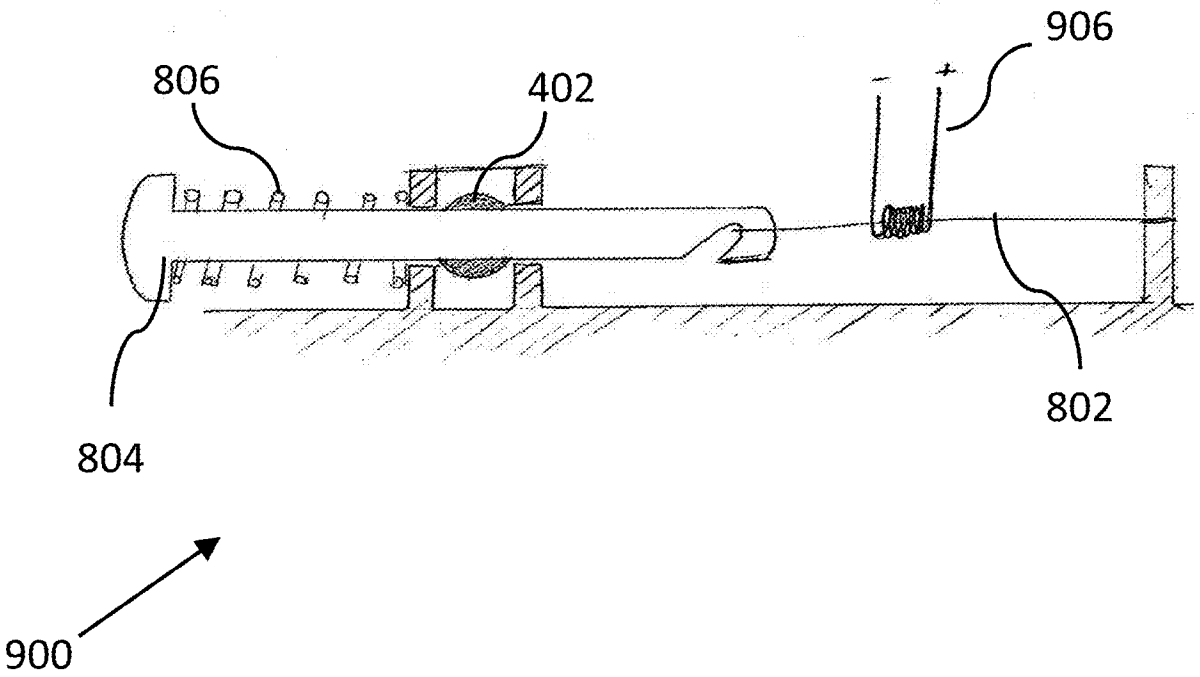
FIG. 9 is a schematic illustration of an automatic activation mechanism of the fire extinguishing device of FIG. 2, in accordance with some demonstrative embodiments described herein.

According to some embodiments, as described in detail with regard to FIG. 9, string 802 may be torn when fire extinguisher 200 is in the second operating mode, and accordingly pin 804 is released, thereby releasing stopper 402.

Reference is now made to FIG. 9. which is a schematic side cross-section illustration of an automatic activation mechanism 900 of the fire extinguishing fire extinguisher 200 of FIG. 2 in accordance with some demonstrative embodiments described herein.

As shown in FIG. 9, automatic activation mechanism 900 includes pin 804 of FIG. 8, spring 806 of FIG. 8, stopper 402 of FIG. 4, and string 802 of FIG. 8, configured to keep pin 804 in place and prevent the un-necessary release of stopper 402.

According to some embodiments, when fire extinguisher 200 is in the second operating mode, a detector (not shown in the figure), send a signal to an operator (not shown in the figure), which in turn heats wire 906. Heated wire 906 causes string 802 to tear, thereby releasing pin 804, and releasing stopper 402.

According to some embodiments, the operator may heat wire 906 by operating a battery. According to other embodiments, the operator may be a battery, e.g., 1.5 volt battery.

Figure 10:
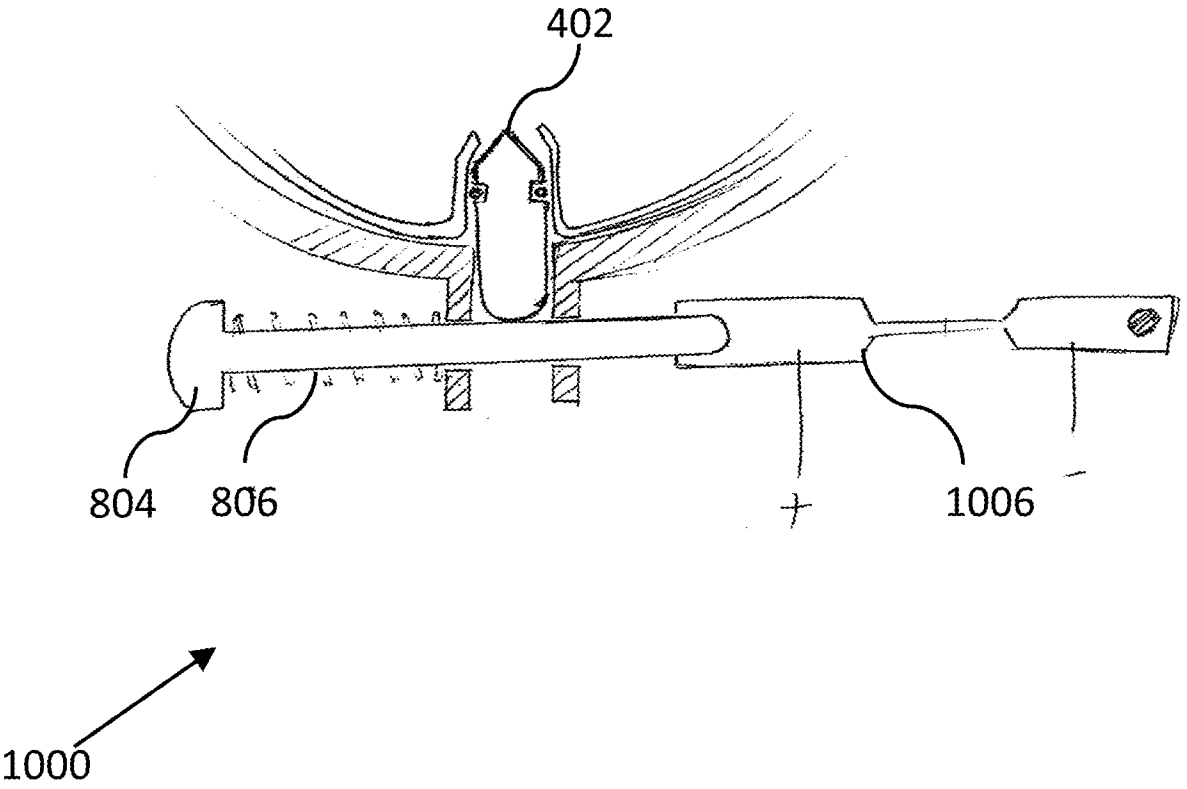
FIG. 10 is a schematic illustration of an automatic activation mechanism of the fire extinguishing device of FIG. 2, in accordance with some demonstrative embodiments described herein.

Reference is now made to FIG. 10. which is a schematic top plane cross-section illustration of an automatic activation mechanism 1000 of fire extinguisher 200 of FIG. 2 in accordance with some demonstrative embodiments described herein.

As shown in FIG. 10, automatic activation mechanism 1000 includes pin 804 of FIG. 8, spring 806 of FIG. 8, stopper 402 of FIG. 4, and metal connector 1006.

According to some embodiments, connector 1006 is configured to keep pin 804 in place and prevent the unnecessary release of stopper 402, e.g., whenever fire extinguisher 200 is not in the second mode of operation. According to some embodiments, when fire extinguisher 200 is in the second operating mode, a detector (not shown in the figure), send a signal to an operator (not shown in the figure), which in turn heats connector 1006. Heated connector 1006 breaks due to the heat, thereby releasing pin 804, and releasing stopper 402.

According to some embodiments, the operator may heat connector 1006 by operating a battery. According to other embodiments, the operator may be a battery, e.g., 1.5 volt battery.

Figure 11:
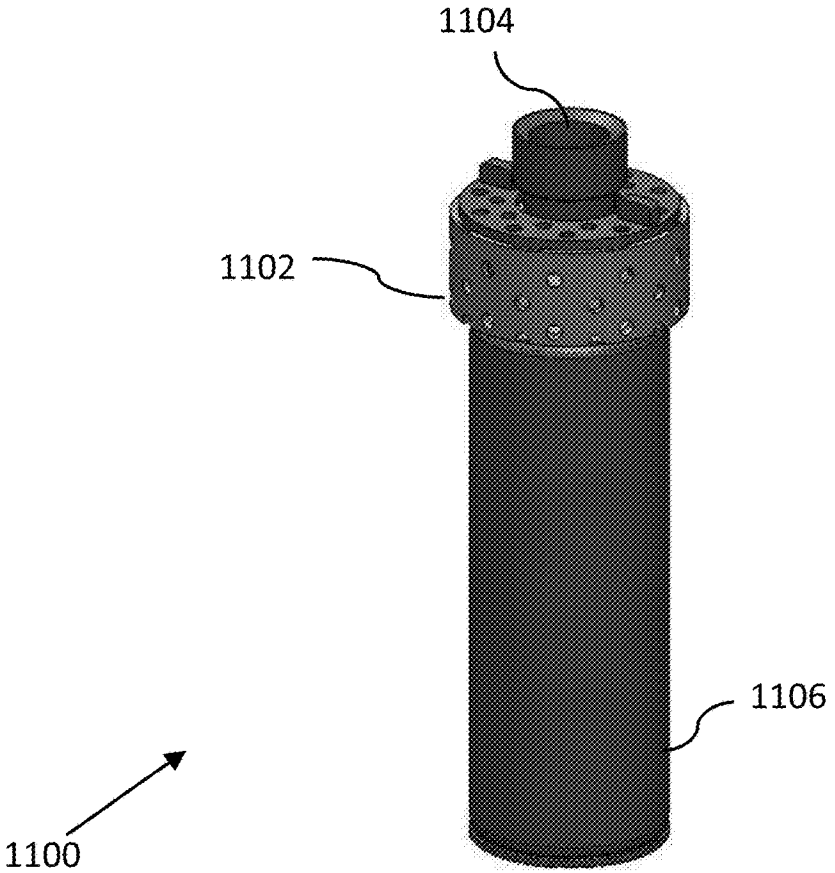
FIG. 11 illustrates an isometric view of a fire extinguisher with a device in accordance with some demonstrative embodiments described herein.

Reference is now made to FIG. 11, which illustrates a fire extinguisher 1100 according to some demonstrative embodiments described herein.

As shown in FIG. 11, extinguisher 1100 may include a body 1106 a apparatus 1102 and an adaptor 1104.

According to some embodiments, a common fire extinguisher may include a body, such as body 1106, containing a fire extinguishing material and a head, including for example, a handle, nozzle and one or more safety mechanisms. According to some embodiments, apparatus 1102 may be installed on any common fire extinguisher, for example, by first removing the head, installing the device onto the body of the extinguisher and installing the head onto apparatus 102.

According to some embodiments, the head of extinguisher 1100 (not shown in the figure) may be installed onto apparatus 1102 via adapter 1104. According to some demonstrative embodiments, when extinguisher 1100 is operated via a manual operation, the head of the extinguisher is used, e.g., a handle is pressed to extrude the extinguishing material via the nozzle. According to other demonstrative embodiments, when extinguisher 1100 is operated via an automatic operation, apparatus 1102 is used to automatically detect the presence of a fire and/or smoke and accordingly operate to extrude the fire extinguishing material from the fire extinguisher.

Figure 12:
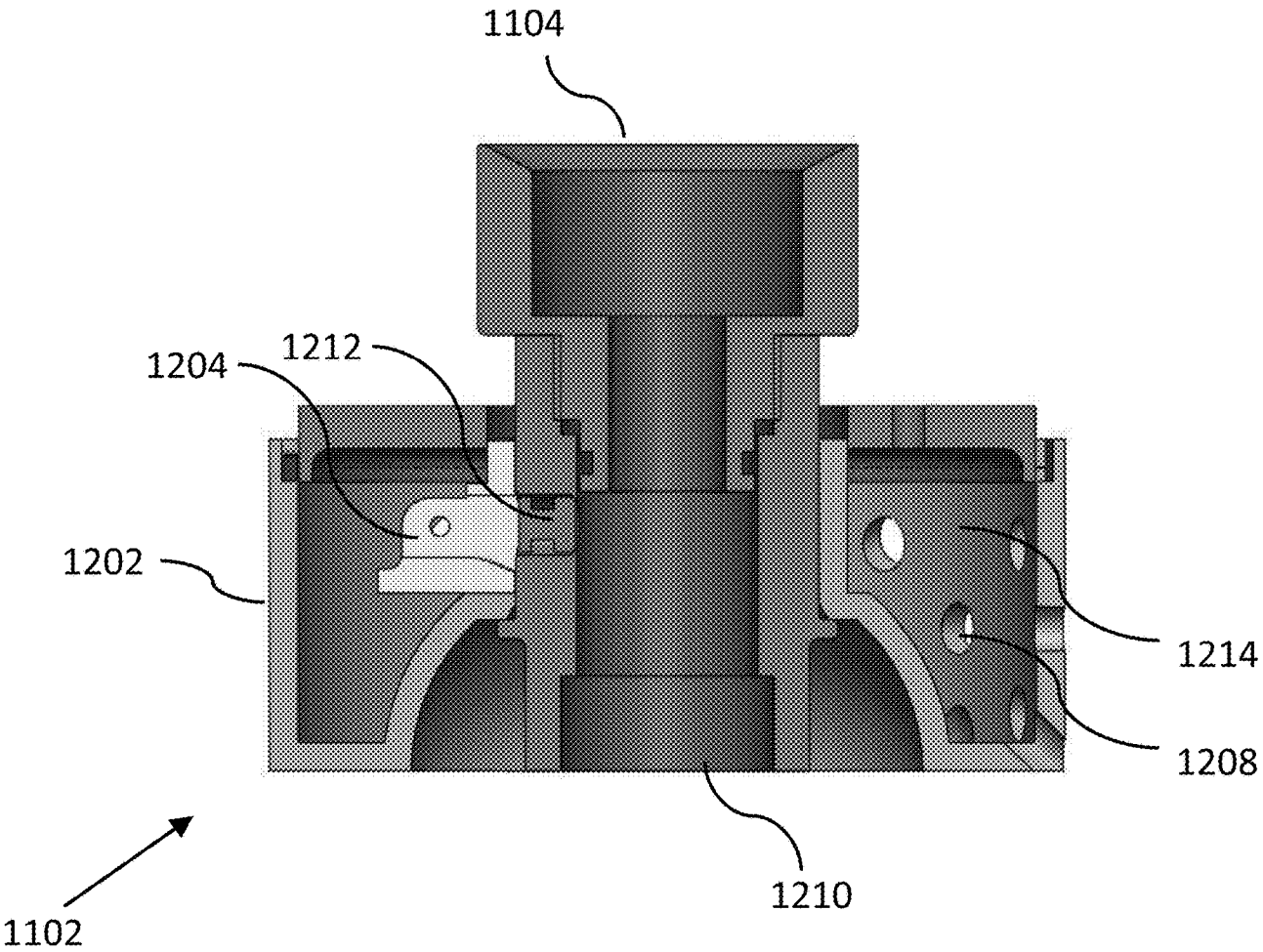
FIG. 12 illustrates a cross-section view of a device in accordance with some demonstrative embodiments described herein.

Reference is now made to FIG. 12, which illustrates a cross section view of apparatus 1102 in accordance with some demonstrative embodiments. According to some embodiments, apparatus 1102 may be installed upon a fire extinguisher via at least one adapter 1210, adapted to attach to a body of the fire extinguisher, for example, body 1106 (FIG. 11).

In some embodiments, the head of the extinguisher, e.g., as described with reference to FIG. 11, may be installed onto apparatus 1102, e.g., via adapter 1104.

According to some embodiments, apparatus 1102 may enable the automatic detection of a fire and/or smoke and accordingly automatically disperse the fire extinguishing material encompassed in the fire extinguisher.

According to some demonstrative embodiments, apparatus 1102 may include one or more components described in any one of FIGS. 1-10, in order to enable the automatic operation of apparatus 1102 upon detection of a fire and/or smoke.

For example, apparatus 1102 may include a releasing stopper 1212, e.g., having the same action as releasing stopper 402 described hereinabove. According to some embodiments, apparatus 1102 may include stopping mechanism 1204, configured to keep releasing stopper 1212 in place when a fire and/or smoke is not detected. In some embodiments, stopping mechanism 1204 may include one or more components configured to keep releasing stopper 1212 in place when a fire and/or smoke is not detected and release releasing stopper 1212 when a fire and/or smoke is detected. For example, stopping mechanism 1204 may include components having substantially the same activity and/or structure as spring 406 and/or rod 404 (FIG. 4).

According to some embodiments, apparatus 1102 may be configured to automatically detect the presence of a fire and/or smoke and include at least one detector, at least one releasing stopper and at least one stopping mechanism, e.g., configured to stop the releasing stopper.

In some embodiments, when the fire extinguisher is operating in the second mode of operation, i.e., the automatic mode of operation, stopping mechanism 1204 enables the release of releasing stopper 1212 and accordingly the release of the fire extinguishing material from the fire extinguisher.

According to some embodiments, apparatus 1102 may include one or more hole(s) 1208 to enable the effective extrusion of the fire extinguishing material from the fire extinguisher. In some embodiments, the position of holes 1208 in designed to enable the substantially equal spread of the fire extinguishing material from the fire extinguisher.

According to some embodiments, holes 1208 are evenly spread throughout the surface of apparatus 1102.

According to other embodiments, and as shown in FIG. 12, holes 1208 are not evenly spread throughout the surface of apparatus 1102, for example, a portion of apparatus 1102 which is located in front of releasing stopper 1212 (portion 1202) may not include holes 1208 at all, or alternatively may include holes which are smaller in diameter in comparison to other holes located on the surface of apparatus 1102. According to these embodiments, most of the holes of apparatus 1102 may be located in a portion of apparatus 1102 which is not located in front of releasing stopper 1212 (e.g., portion 1214).

Figure 13:
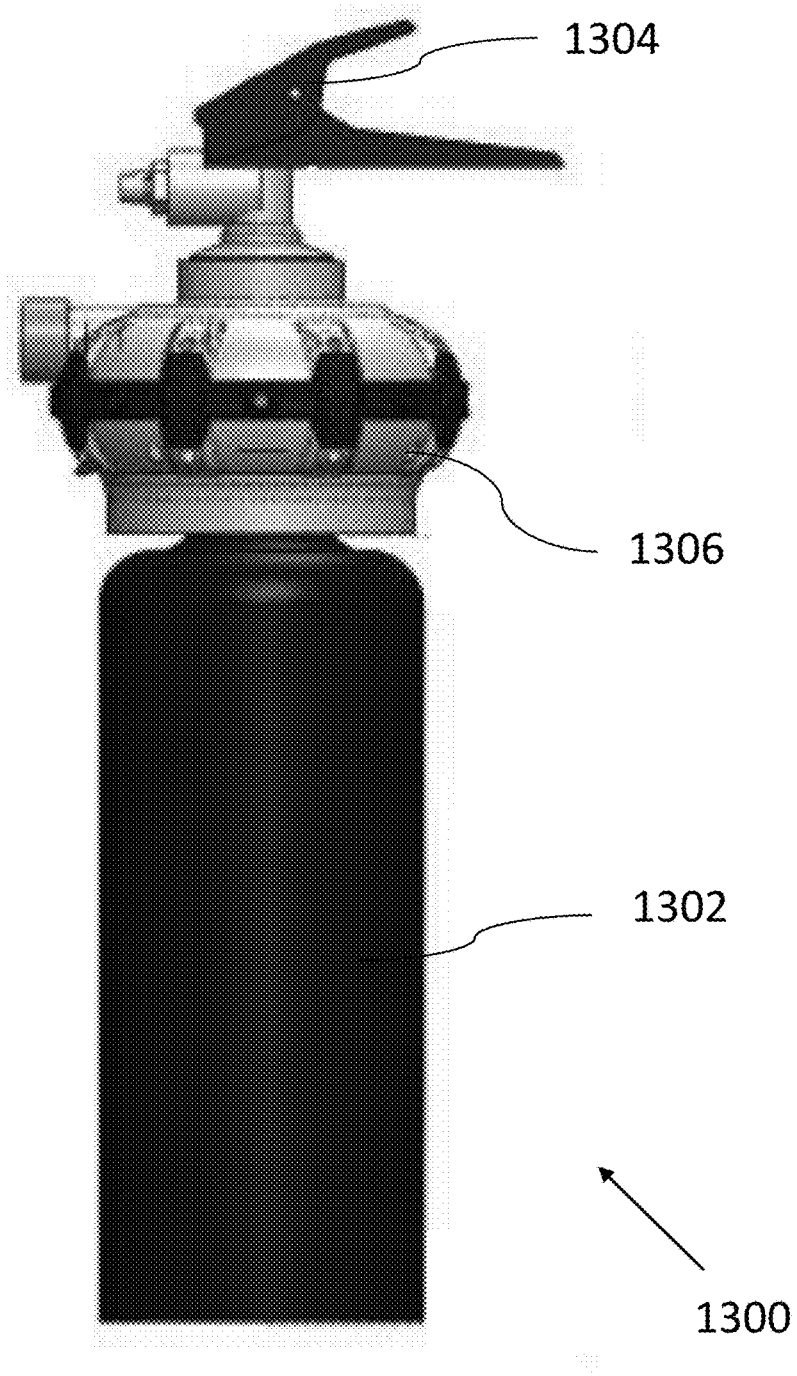
FIG. 13 illustrates a side view of a fire extinguisher in accordance with some demonstrative embodiments described herein.

According to some embodiments, the lack of holes 1208 on portion 1202 contributes to the substantially even spread of the fire extinguishing material since the highest pressure upon the release of the fire extinguishing material is exhibited right in front of releasing stopper 1212. Positioning holes which are equal in diameter to other holes positioned throughout the surface of apparatus 1102 may cause most of the fire extinguishing material to be extruded through the holes of portion 1202, where little or no fire extinguishing material will reach holes 1208 of portion 1214, e.g., thereby causing a non-even spread of the fire extinguishing material and a less effective extinguishment of a fire. Reference is now made to FIG. 13, which illustrates a side view of a fire extinguisher 1300 in accordance with some demonstrative embodiments. As shown in FIG. 13, fire extinguisher 1300 may include a body 1302, e.g., intended to be filled with a fire extinguishing agent, a head 1304, e.g., including, a handle, nozzle and one or more safety mechanisms, and an apparatus 1306 of the present invention.

In some embodiments, as detailed below, apparatus 1306 may include one or more mechanisms to enable the automatic detection of a fire, and/or the subsequent automatic operation of fire extinguisher 1300.

According to some demonstrative embodiments, apparatus 1306 may be positioned between nozzle 1304 and body 1302. According to these embodiments, the position of apparatus 1306 between nozzle 1304 and body 1302 may be preferable as said apparatus may efficiently detect a fire and also may not interfere with a manual operation of fire extinguisher 1300, as explained in detail below.

According to some embodiments, fire extinguisher 1300 may be operated in at least one of three ways:

1. Automatic "Sprinkler like" operation—According to some embodiments, fire extinguisher 1300 may be placed upon a wall, wherein apparatus 1306 essentially constantly measures one or more environmental parameters, e.g., environmental temperature, to detect the existence of a fire.

According to some embodiments, upon detection of a fire apparatus 1306 will cause the automatic operation of fire extinguisher 1300, causing a fire extinguishing agent contained in fire extinguisher 1300 to be dispersed onto the fire.

2. "Fire extinguishing grenade" operation—According to some embodiments, if a user of fire extinguisher 1300 identifies a fire, the user may throw fire extinguisher 1300 into the fire, thereby causing apparatus 1306 to detect the existence of the fire and cause the automatic operation of fire extinguisher 1300.

3. Manual operation—According to some embodiments, apparatus 1306 does not prevent the user of fire extinguisher 1300 to use fire extinguisher 1300 manually, e.g., by squeezing head 1304 of fire extinguisher 1300 thereby causing the fire extinguishing agent to be dispersed.

According to some demonstrative embodiments, these optional operation modes may enable a highly effective protection mechanism against fires, wherein fire extinguisher 1300 may either be used by a user, or operated automatically when a fire breaks out.

Figure 14:
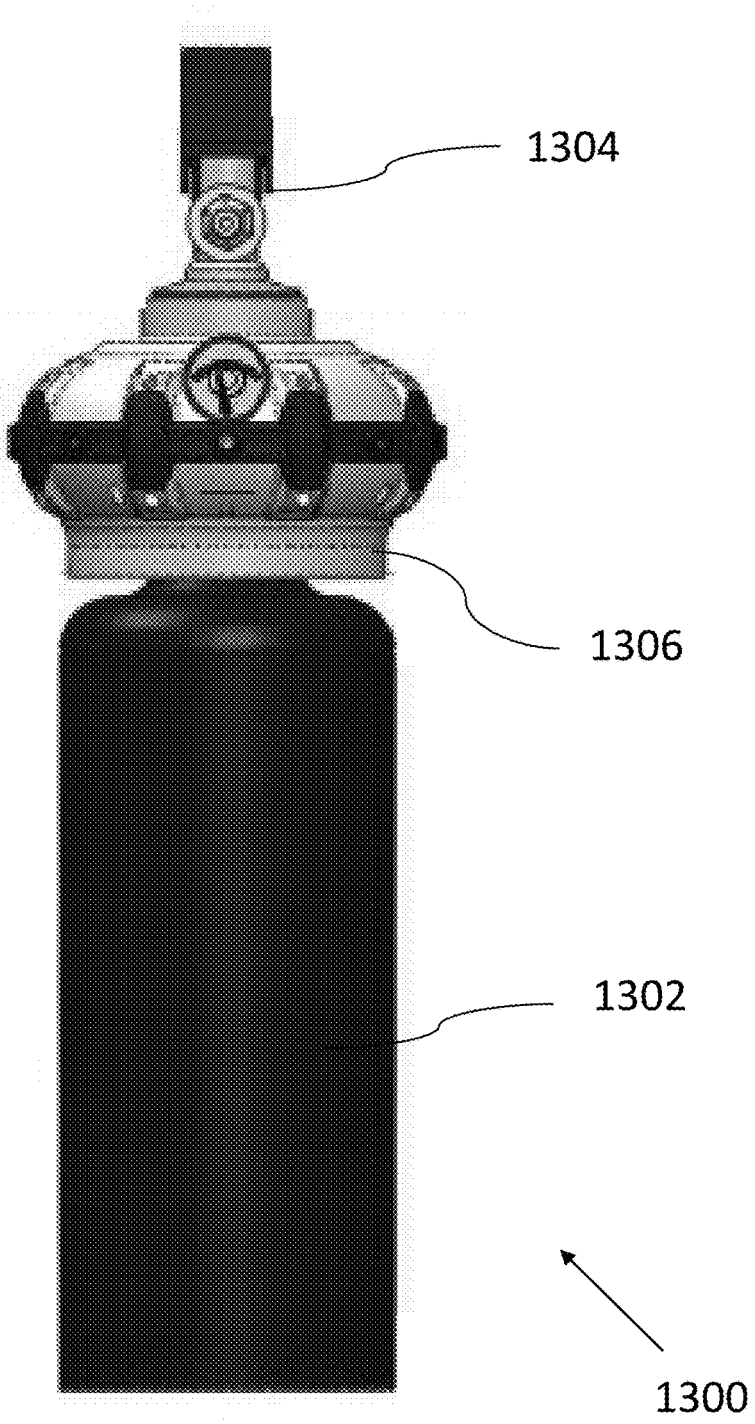
FIG. 14 illustrates a front view of a fire extinguisher in accordance with some demonstrative embodiments described herein.
Figure 15:
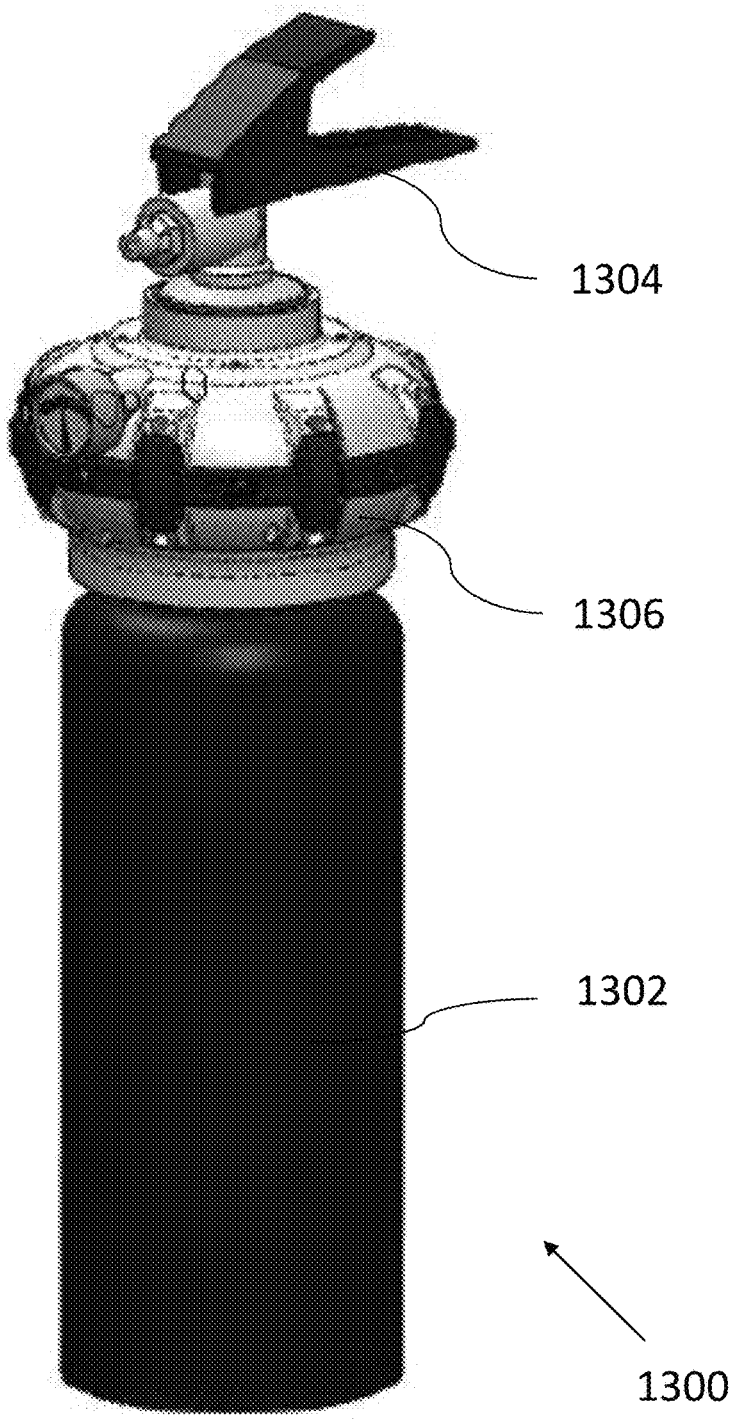
FIG. 15 illustrates an isometric view of a fire extinguisher in accordance with some demonstrative embodiments described herein.

FIGS. 14 and 15 are front and isometric views of fire extinguisher 1300, respectively.

Figure 16:
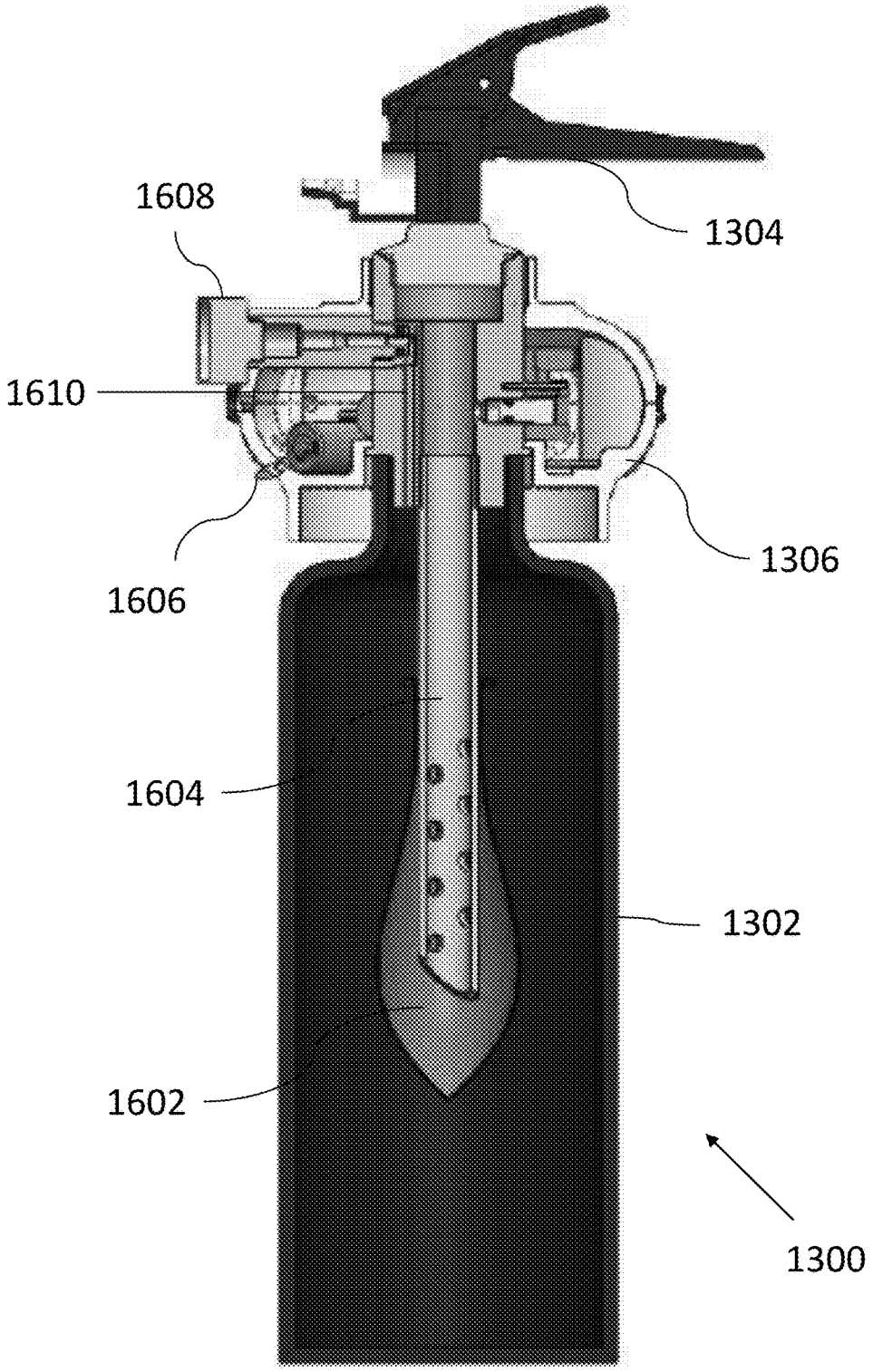
FIG. 16 is a cross section side view of a fire extinguisher in accordance with some demonstrative embodiments described herein.

FIG. 16 is a cross section side view of fire extinguisher 1300 according to some demonstrative embodiments. As shown in FIG. 16, fire extinguisher 1300 may include a body 1302, e.g., intended to be filled with a fire extinguishing agent, a head 1304, e.g., including, a handle, nozzle and one or more safety mechanisms, and an apparatus 1306 of the present invention.

According to some embodiments, body 1302 may include at least one fire extinguishing agents.

As shown in FIG. 16, fire extinguisher 1300 may include a central tube 1604, configured to enable the flow of the fire extinguishing agent from body 1302 through tube 1604 and exerted from head 1304. According to some embodiments, the at least one fire extinguishing agent may be contained within a balloon 1602.

According to some embodiments, balloon 1602 may be made of any suitable elastic material, including, for example, rubber, silicone, elastic polymers and the like.

In some demonstrative embodiments, body 1302 may be filled with a gas, for example any suitable propellant that can enable the creation of pressure onto balloon 1602, e.g., nitrogen gas.

According to some embodiments, the use of balloon 1602 may enable the extrusion of the fire extinguishing agent, when fire extinguisher 1300 is essentially at any position. For example, fire extinguisher 1300 may be operated (whether manually or automatically) at any of the following positions: upright ("standing") position, horizontal position, e.g. while lying on the ground, whether vertically or at an angle.

According to some embodiments, the gas contained in body 1302 constantly pushes balloon 1602. In light of the constant pressure on balloon 1602, if fire extinguisher 1300 is operated, e.g., manually via head 1304 or automatically via apparatus 1306, the fire extinguishing agent contained within balloon 1602 is pushed through tube 1604 and is exerted from fire extinguisher 1300.

In some demonstrative embodiments, apparatus 1306 may include a pressure monitor 1608, e.g., an analogic and/or digital monitor. According to some embodiments, the gas may be filled to body 1302 via tube 1610. According to some other demonstrative embodiments, the gas may be filled via one or more other means (not show in the figure), including for example, via one or more hatches or tubes located on the bottom portion of body 1302 or on the side of body 1302.

In some demonstrative embodiments, tube 1610 may include one or more suitable valves, such as a pneumatic valve, e.g., Schrader valve (also called American valve), Dunlop or Presta valve, to ensure the unidirectional filling of the gas into body 1302.

According to some embodiments, pressure monitor 1608 may be connected to tube 1610, e.g., and continuously measuring the pressure of the gas contained in body 1302. According to some demonstrative embodiments, monitor 1608 may include any suitable pressure meter used to monitor, alert and/or regulate the gas pressure contained within body 1302.

According to some embodiments, apparatus 1306 may include one or more detectors 1606, configured to detect the existence of a fire.

According to some demonstrative embodiments, detector 1606 may be any suitable electronic or mechanical device, configured to sense and/or identify the existence of any suitable indicator of a fire, including for example, elevated temperature, smoke, elevated $CO_2$ levels and the like. For example, detector 1606 may be selected from a group including: temperature detectors, e.g., configured to detect the elevation of temperature such as EN54-5; flame detectors, e.g., optical type detectors such as Ultraviolet flame detectors, Near infrared (IR) Array flame detectors, infrared flame detectors, UV and IR flame detectors, IR/IR flame detectors, IR3 flame detectors; Ionization current flame detectors; Thermocouple flame detectors; smoke detectors, such as Air-sampling detectors, Carbon monoxide and/or carbon dioxide detectors, Ionization detectors, Photoelectric detectors, Beam operated detectors, Aspirating detectors, Laser detectors, EN54-7 detectors and the like.

Figure 17:
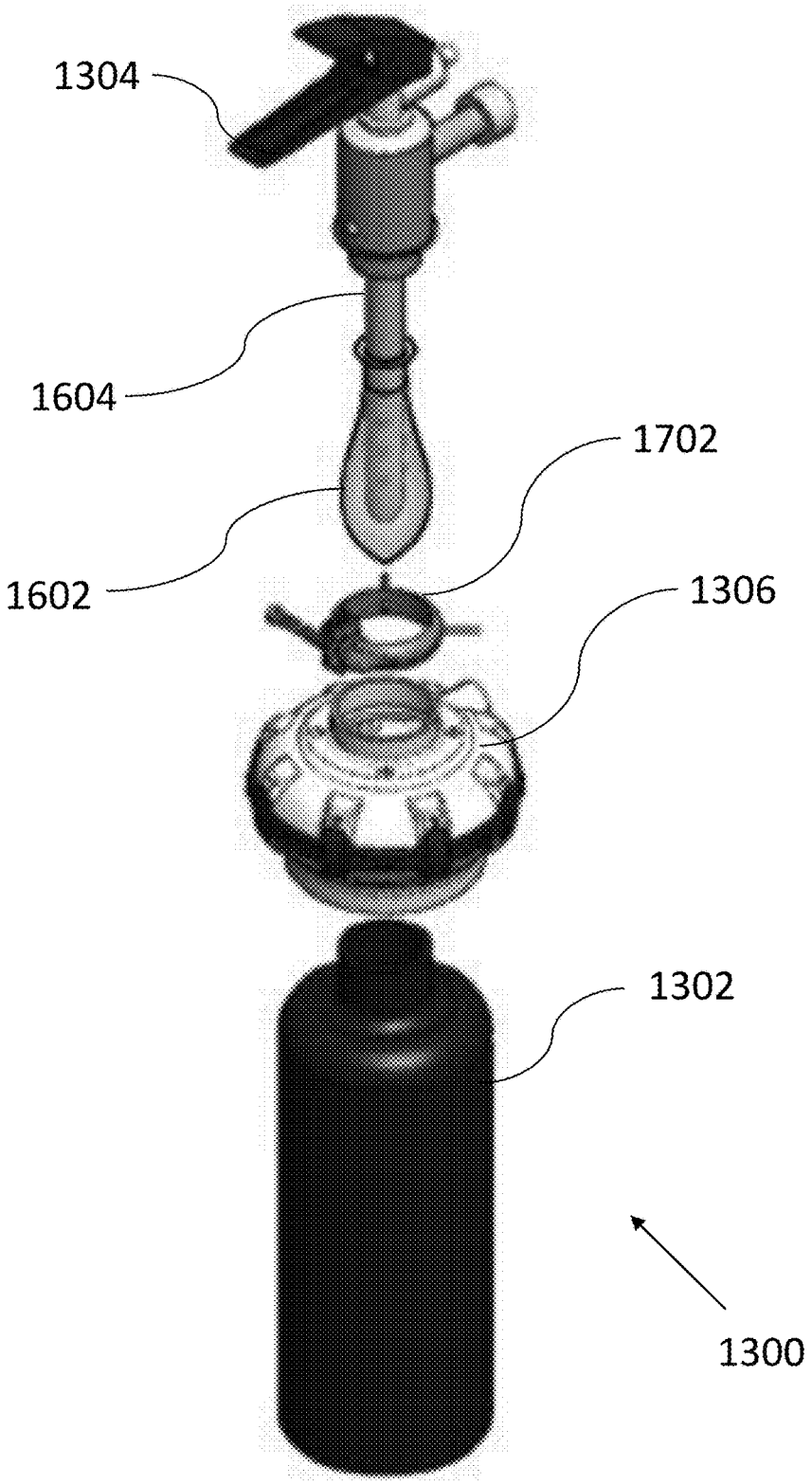
FIG. 17 illustrates a disassembled view of a fire extinguisher in accordance with some demonstrative embodiments described herein.

Reference is now made to FIG. 17 which illustrated a disassembled view of fire extinguisher 1300, according to some demonstrative embodiments.

As shown in FIG. 17, fire extinguisher 1300 may include body 1302, head 1304, apparatus 1306, central tube 1604, balloon 1602 and automatic discharge ring 1702.

Figure 19:
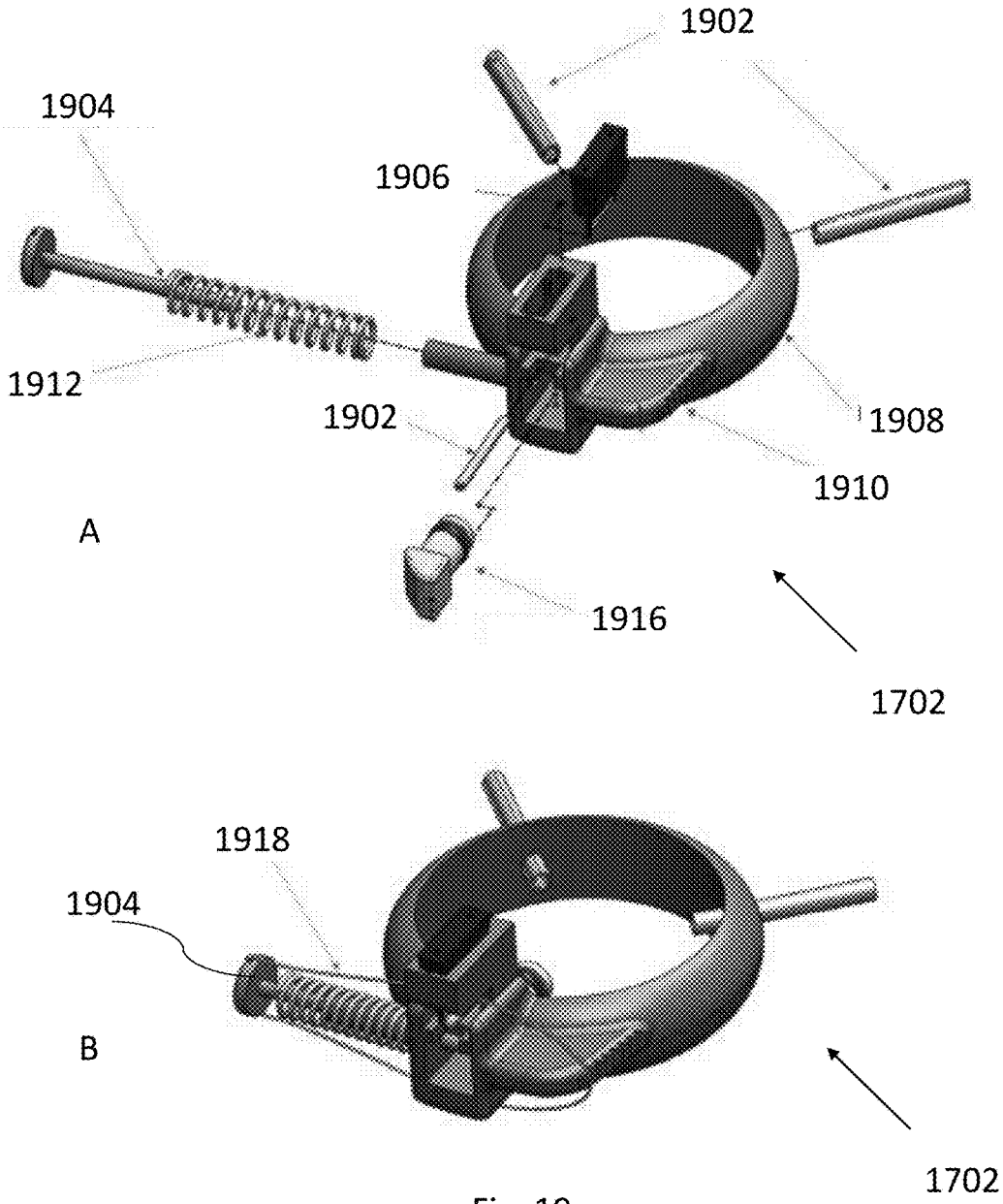
FIGS. 19A and 19B illustrate an automatic discharge ring of a fire extinguisher in accordance with some demonstrative embodiments described herein.

The operation of automatic discharge ring 1702 is explained in detail below with respect to FIG. 19.

Figure 18:
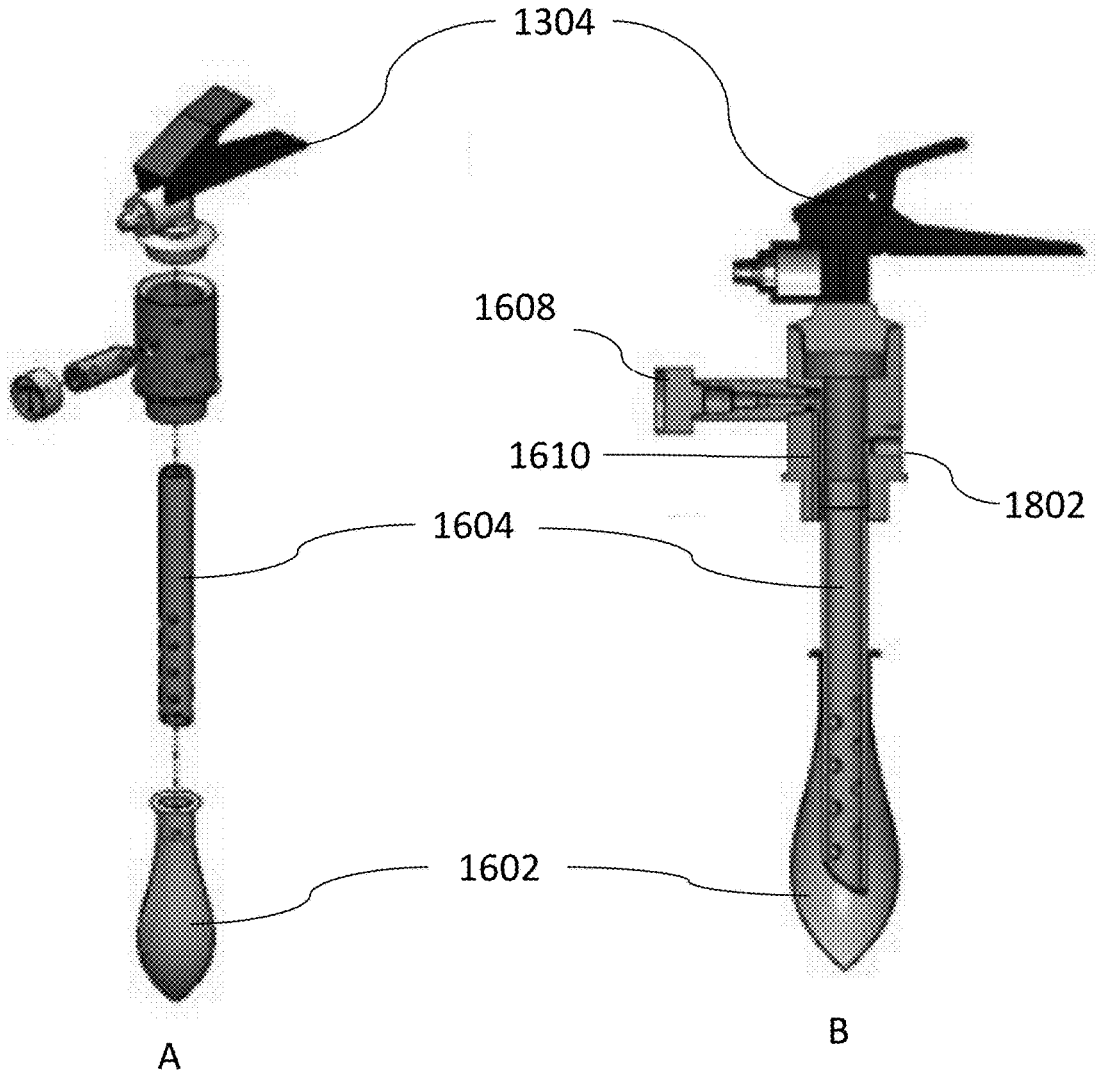
FIGS. 18A and 18B illustrate an inner operating mechanism of a fire extinguisher in accordance with some demonstrative embodiments described herein.

Reference is now made to FIGS. 18A and 18B, which illustrates an inner operating mechanism connected to head 1304, according to some demonstrative embodiments described herein. FIG. 18A illustrates an isometric disassembled view of an inner operating mechanism connected to head 1304 and FIG. 18B illustrates a cross section side view of an inner operating mechanism connected to head 1304.

As shown in FIGS. 18A and 18B, the inner operating mechanism connected to head 1304, may include a central tube 1604, a balloon 1602, pressure monitor 1608, tube 1610 and opening 1802.

According to some embodiments, opening 1802 is connected to central tube 1604, and is configured to enable the insertion of the fire extinguishing agent into balloon 1602.

According to some demonstrative embodiments, the purpose of the inner operating mechanism connected to head 1304 is:

1. To connect between body 1302 (FIG. 13) and head 1304, when fire extinguisher 1300 (FIG. 13) is operated manually.
2. To separate the passage lines of the fire extinguishing agent from the passage lines of the gas, i.e., to ensure complete separation between the gas and the fire extinguishing agent and to essentially ensure proper activation of the fire extinguisher 1300 (FIG. 13), e.g., without any mix between the gas and the fire extinguishing agent.
3. To form a basis for the connection of body 1302 and head 1304. Reference is now made to FIGS. 19A and 19B, which illustrate an automatic discharge ring 1702, according to some demonstrative embodiments described herein.

FIG. 19A illustrates an isometric disassembled view of automatic discharge ring 1702 and FIG. 19B illustrates an isometric assembled view of automatic discharge ring 1702.

As shown in FIG. 19A, automatic discharge ring 1702 may include a stopper 1916, one or more hooking pins 1902, automatic discharge pin 1904, automatic discharge spring 1912, a fixator 1906, automatic discharge ring body 1908 and one or more bumps 1910.

According to embodiments of the present invention, when a fire is detected, e.g., via one or more detectors of apparatus 1306 (FIG. 17), automatic discharge ring 1702 is configured to enable the release of the fire extinguishing agent from fire extinguisher 1300 (FIG. 13).

According to some embodiments, stopper 1916 is configured to be placed at an essentially constant position, to prevent from the extinguishing agent to be an intentionally released from fire extinguisher 1300. According to some embodiments, when apparatus 1306 is activated, e.g., when a fire is detected, stopper 1916 is released from the essentially constant position to enable the release of the fire extinguishing agent from fire extinguisher 1300, and to enable the fire extinguishing agent to be dispersed within apparatus 1306 and be dispersed from fire extinguisher 1300.

According to some demonstrative embodiments, automatic discharge ring 1702 may include an automatic discharge pin 1904 to keep stopper 1916 in the essentially constant position.

According to some demonstrative embodiments, apparatus 1306 (FIG. 13) may have a first operating mode ("standby operating mode") and a second operating mode ("active operating mode").

According to some embodiments, in the standby operating mode automatic discharge pin 1904 keeps stopper 1916 in the essentially constant position, thereby preventing the release of the fire extinguishing agent.

According to other demonstrative embodiments, in the active operating mode automatic discharge pin 1904 is released, thereby allowing stopper 1916 to be released from the essentially constant position, thereby releasing of the fire extinguishing agent.

According to some demonstrative embodiments, automatic discharge spring 1912 is positioned onto automatic discharge pin 1904 and is configured to push automatic discharge pin 1904 to release.

As shown in FIG. 19B, automatic discharge ring 1702 may include at least one security string 1918, to keep automatic discharge pin 1904 in place, i.e., preventing the release of stopper 1916.

According to some embodiments, security string 1918 may be made of any suitable material that can withhold the pressure created by automatic discharge spring 1912, including, for example, nylon, plastic, rubber, metal, fabric, fishing line, Kevlar®, synthetic and/or semi-synthetic fiber and the like.

According to some embodiments, security string 1918 is wrapped around one or more bumps 1910 to enable the firm fixation of string 1918 and lock automatic discharge pin 1904 in place. Since string 1918 may come in different strengths and/or sizes, bumps 1910 may be used to ensure the tight wrapping of string 1918.

According to some embodiments, fixator 1906 is positioned onto or close to security string 1918. In some demonstrative embodiments, fixator 1906 may include a heating element, e.g., a heating wire, configured to be in constant contact or in close proximity to security string 1918.

According to some embodiments, fixator 1906 may include one or more standard electronic connectors, wherein the heating element is position on the electronic connector.

According to some demonstrative embodiments, when apparatus 1306 is in the first operating mode the heating wire is not heated. Upon activation of apparatus 1306, i.e., when apparatus 1306 is in the second operating mode, the heating wire of fixator 1906 is heated, thereby causing the breakage or tear of security string 1918.

Figure 20:
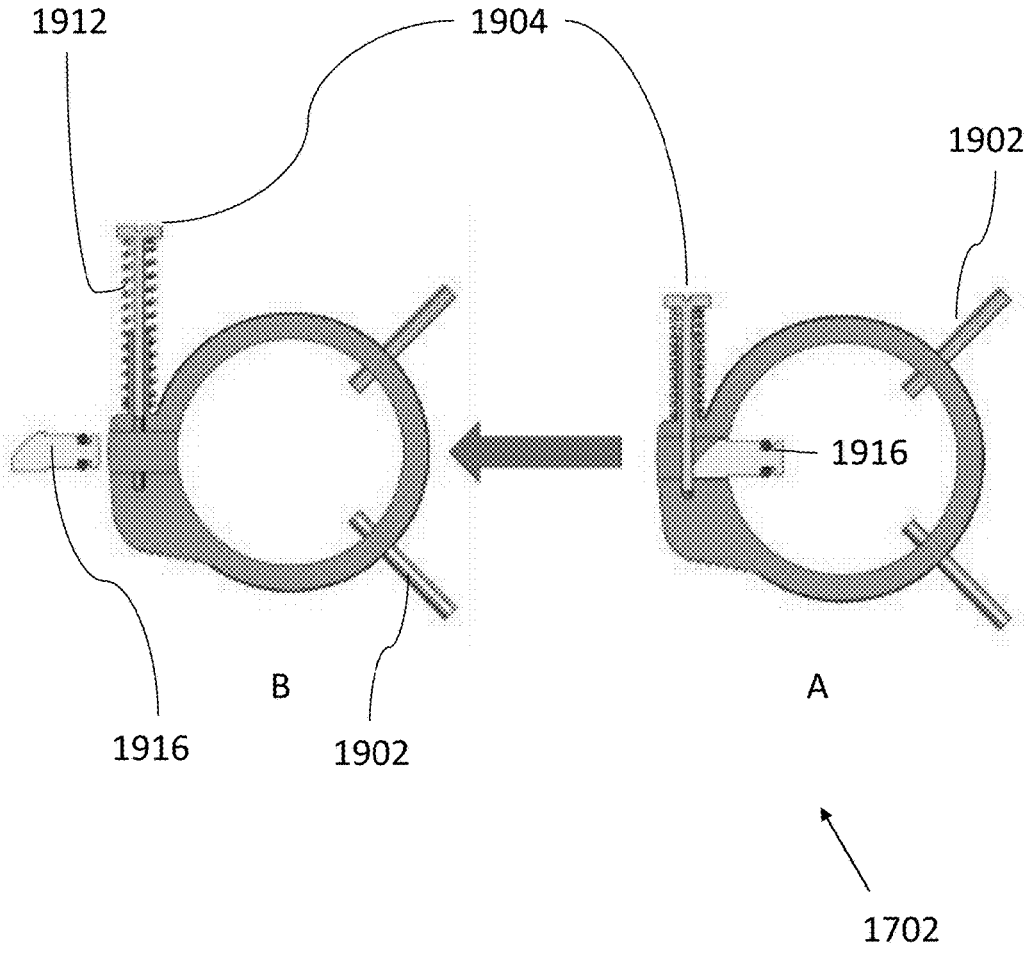
FIGS. 20A and 20B, illustrate a cross section top plane view of an automatic discharge ring, according to some demonstrative embodiments described herein.

Once security string 1918 is torn, automatic discharge spring 1912 pushes and causes the release of automatic discharge pin 1904, as explained in further detail below with regard to FIG. 20.

According to some demonstrative embodiments, automatic discharge ring 1702 may include one or more hooking pins 1902 to firmly position automatic discharge ring 1702 onto fire extinguisher 1300 (FIG. 13).

Reference is now made to FIGS. 20A and 20B, which illustrate a cross section top plane view of automatic discharge ring 1702, according to some demonstrative embodiments described herein. FIG. 20A illustrates automatic discharge ring 1702 when apparatus 1306 (FIG. 13) is in the first operating mode. FIG. 20B illustrates automatic discharge ring 1702 when apparatus 1306 (FIG. 13) is in the second operating mode.

As shown in FIG. 20A, when apparatus 1306 (FIG. 13) is in the first operating mode, stopper 1916 is held in position by pin 1904. Pin 1904 is held in position by string 1918 (not shown in the figure). As shown in FIG. 20A, when apparatus 1306 (FIG. 13) is in the second operating mode, string 1918 (not shown in the figure) is torn, and spring 1912 causes the release of pin 1904, and subsequently the release of stopper 1916.

According to some demonstrative embodiments, stopper 1916 may be at any suitable shape to enable the quick release upon activation of apparatus 1306 (FIG. 13). Preferably, stopper 1916 may have an angled ending to facilitate the release of pin 1904 upon activation of apparatus 1306 (FIG. 13).

Figure 21:
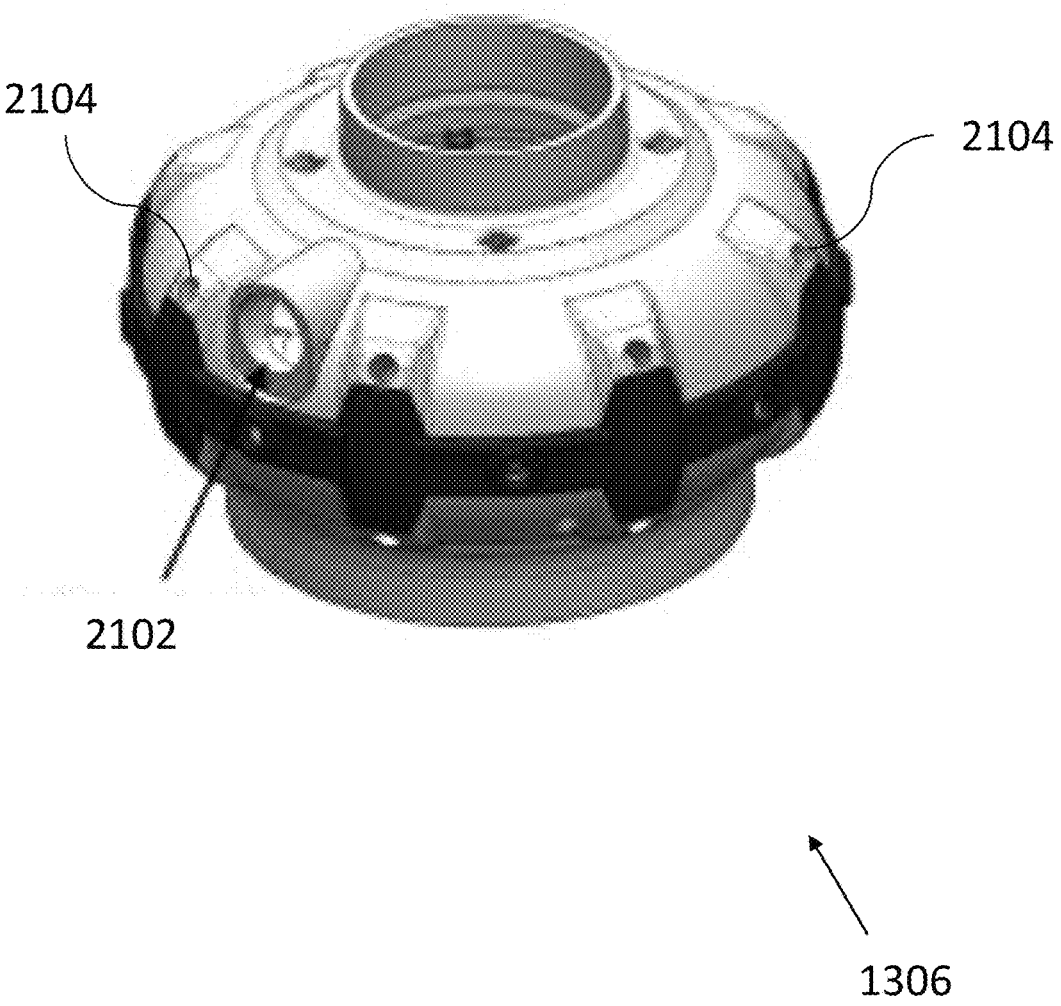
FIG. 21 illustrates an isometric view of an apparatus, according to some demonstrative embodiments described herein.

Reference is now made to FIG. 21, which illustrates an isometric view of apparatus 1306, according to some demonstrative embodiments described herein.

As shown in FIG. 21, apparatus 1306 may include one or more holes 2104 to enable the release of the fire extinguishing agent when apparatus 1306 is in the second operating mode. According to some embodiments, holes 2104 are evenly spread on the surface of apparatus 1306, e.g., to provide an essentially even spread of the fire extinguishing agent upon release from extinguisher 1300 (FIG. 13). According to other embodiments, holes 2104 are not evenly spread through the surface of apparatus 1306. For example, according to some embodiments, a first portion of the surface of apparatus 1306 may have no holes, a small number of holes (between 1-4) or holes of a different size and/or diameter, e.g., small size, than other holes on a second portion of the surface of apparatus 1306. According to preferred embodiments, the first portion of the surface of apparatus 1306 may be positioned right in front of stopper 1916 (FIG. 19). If a the number of holes or the size of holes on the first portion is lower than of those on the second portion, a more even spread of the fire extinguishing agent within apparatus 1306 may be achieved.

According to some embodiments, holes 2104 are positioned on the surface of apparatus 1306, at specific locations to essentially provide a 360° coverage release of the fire extinguishing agent upon release from fire extinguisher 1300.

Figure 22:
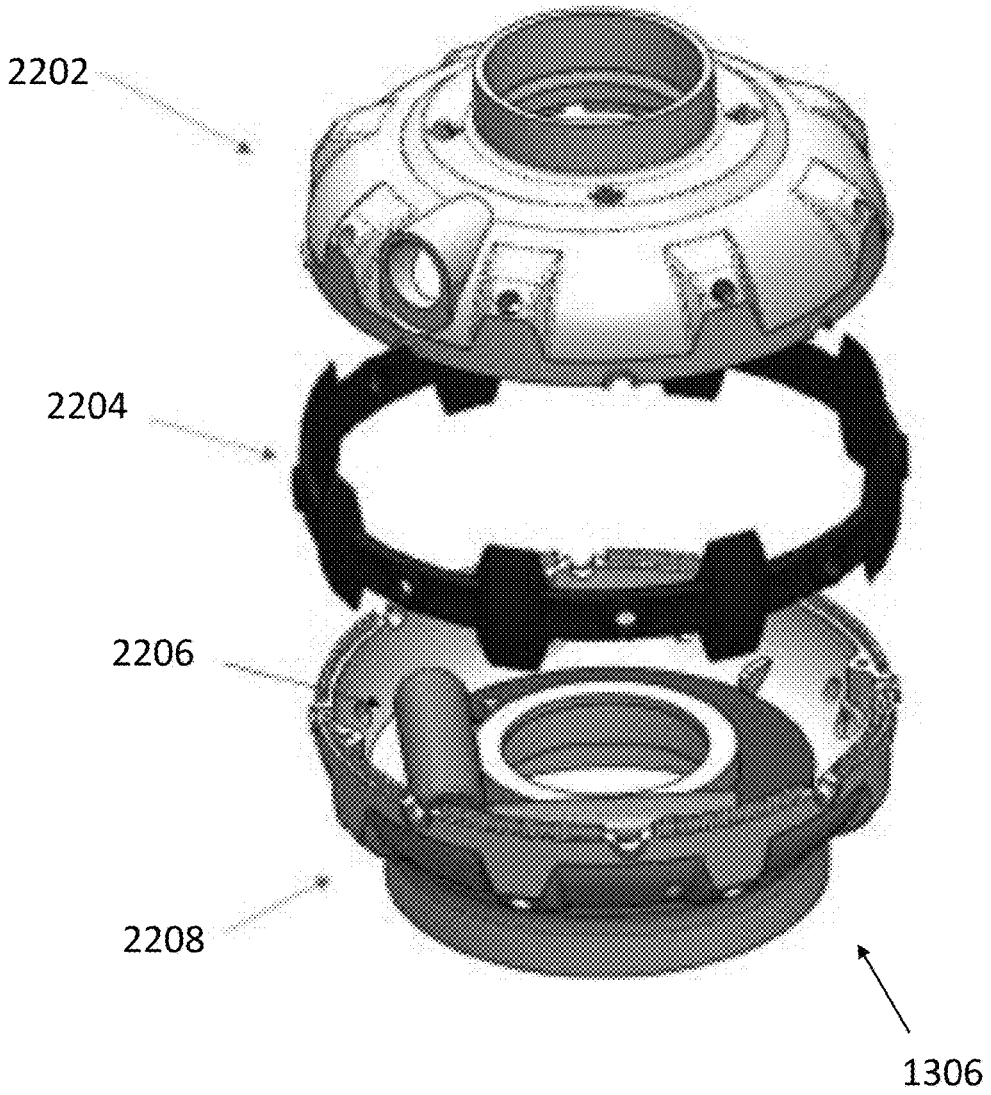
FIG. 22 illustrates an isometric disassembled view of an apparatus, according to some demonstrative embodiments.

Reference is now made to FIG. 22 which illustrates an isometric disassembled view of apparatus 1306, according to some demonstrative embodiments.

Figure 23:
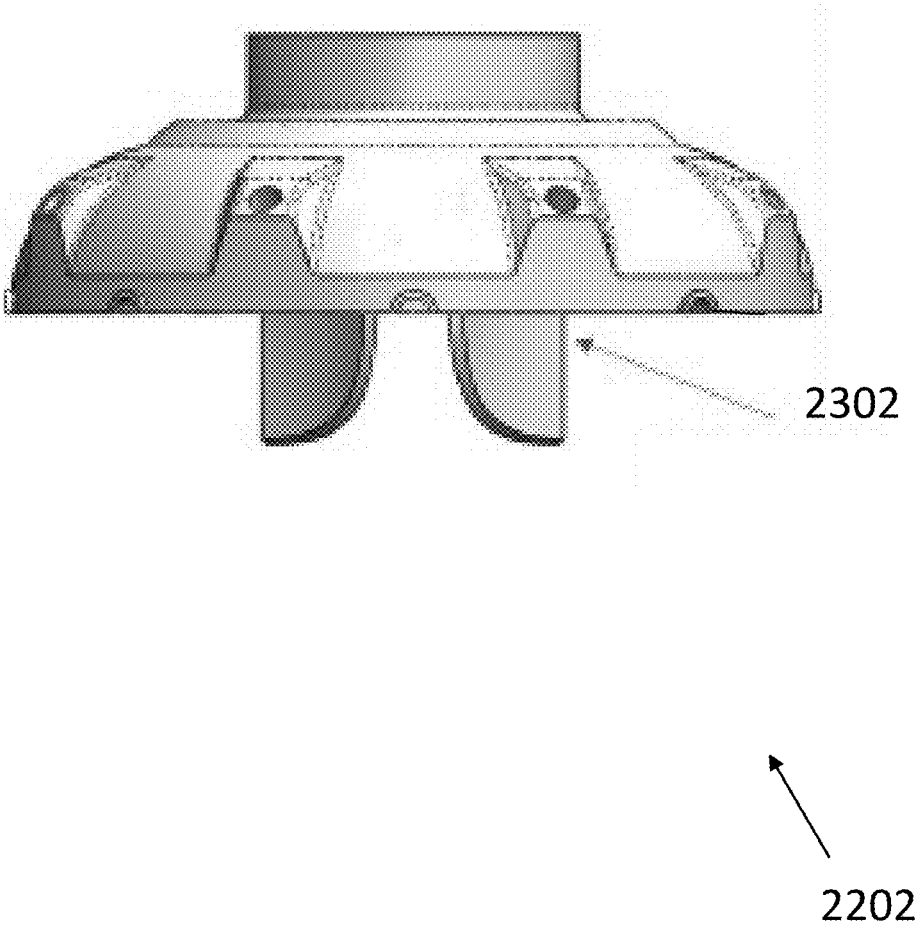
FIG. 23 illustrates a front view of an upper cover of an apparatus, in accordance with some demonstrative embodiments described herein.

As shown in FIG. 22, apparatus 1306 may include upper cover 2202 and lower cover 2208, outer rubber ring 2204 and electronic mechanism 2206. Reference is now made to FIG. 23, which illustrates a front view of upper cover 2202, according to some demonstrative embodiments described herein.

According to some embodiments, rubber ring 2204 may absorb some of the impact if fire extinguisher 1300 (FIG. 13) is thrown on the ground, and accordingly diminish the chances of breakage of fire extinguisher 1300 (FIG. 13). According to other embodiments, rubber ring 2204 may also prevent or diminish the rolling of fire extinguisher 1300 (FIG. 13) on the ground, for example, if fire extinguisher 1300 (FIG. 13) is thrown into the center of a fire zone, rubber ring 2204 may prevent from fire extinguisher 1300 (FIG. 13) from rolling outside the fire zone.

As shown in FIG. 23, upper cover 2202 may include an inner barrier 2302. According to some embodiments, inner barrier 2302 enables a preferred dispersion of the fire extinguishing agent within apparatus 1306 (FIG. 13), when apparatus 1306 is in the second operating mode and the fire extinguishing agent is released. The preferred dispersion of the fire extinguishing agent can be understood from FIG. 24.

Figure 24:
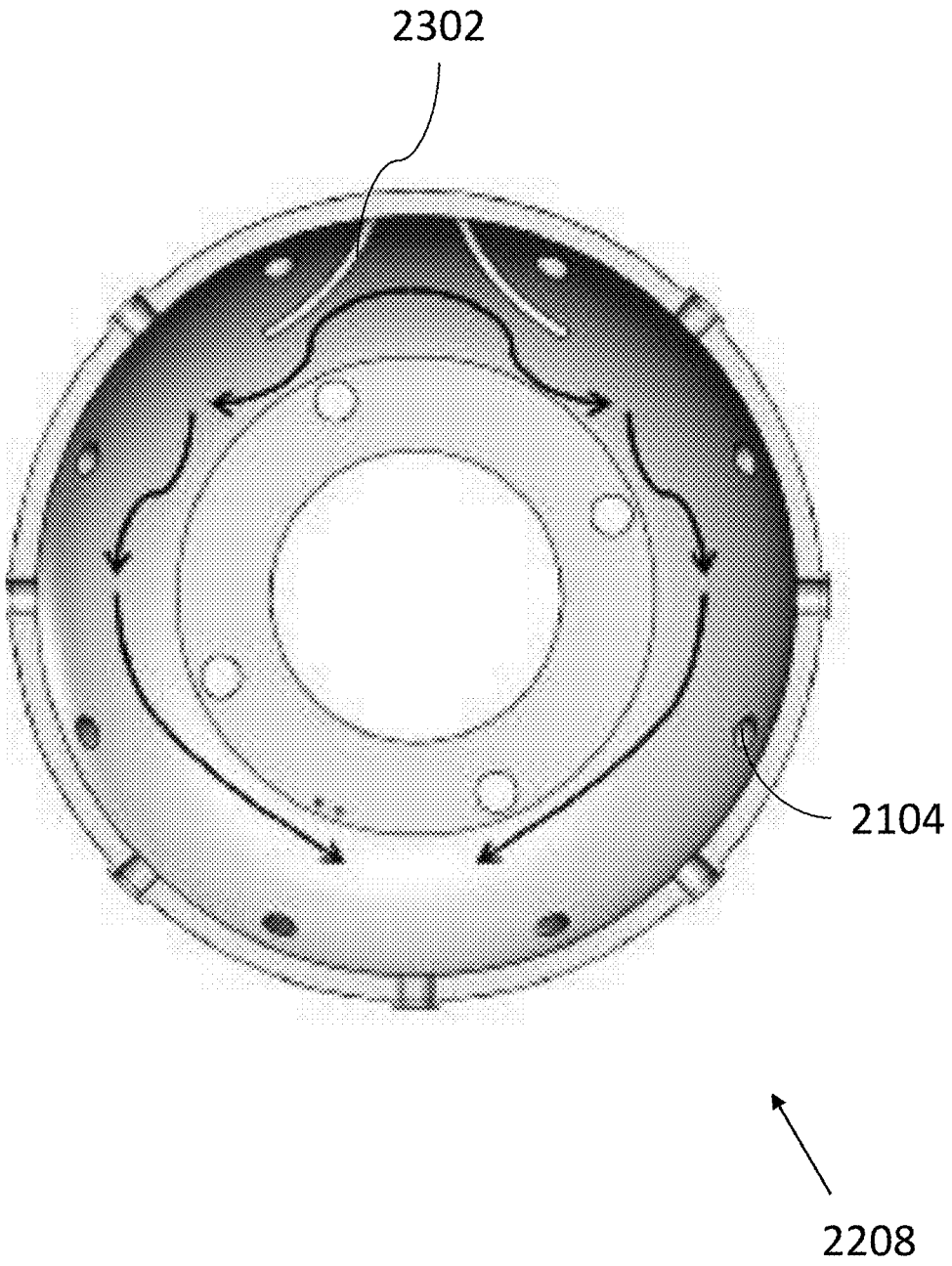
FIG. 24 illustrates an upper view of lower cover of an apparatus, in accordance with some demonstrative embodiments described herein.

Reference is now made to FIG. 24, which illustrates an upper view of lower cover 2208 when apparatus 1306 is in the second activating mode, according to some demonstrative embodiments described herein.

As shown in FIG. 24, when apparatus 1306 is activated, e.g., when activating in the second activating mode, the fire extinguishing agent is release from body 1302 (FIG. 13) and is dispersed throughout apparatus 1306, to be released from apparatus 1306 via one or more holes 2104. According to some embodiments, barrier 2302 enables a preferred dispersion of the fire extinguishing agent within apparatus 1306. This is demonstrated via the black arrows appearing in FIG. 24. The preferred dispersion of the fire extinguishing agent within apparatus 1306 provides for a more evenly release of the fire extinguishing agent from apparatus 1306 via one or more holes 2104 (not shown in the figure).

Figure 25:
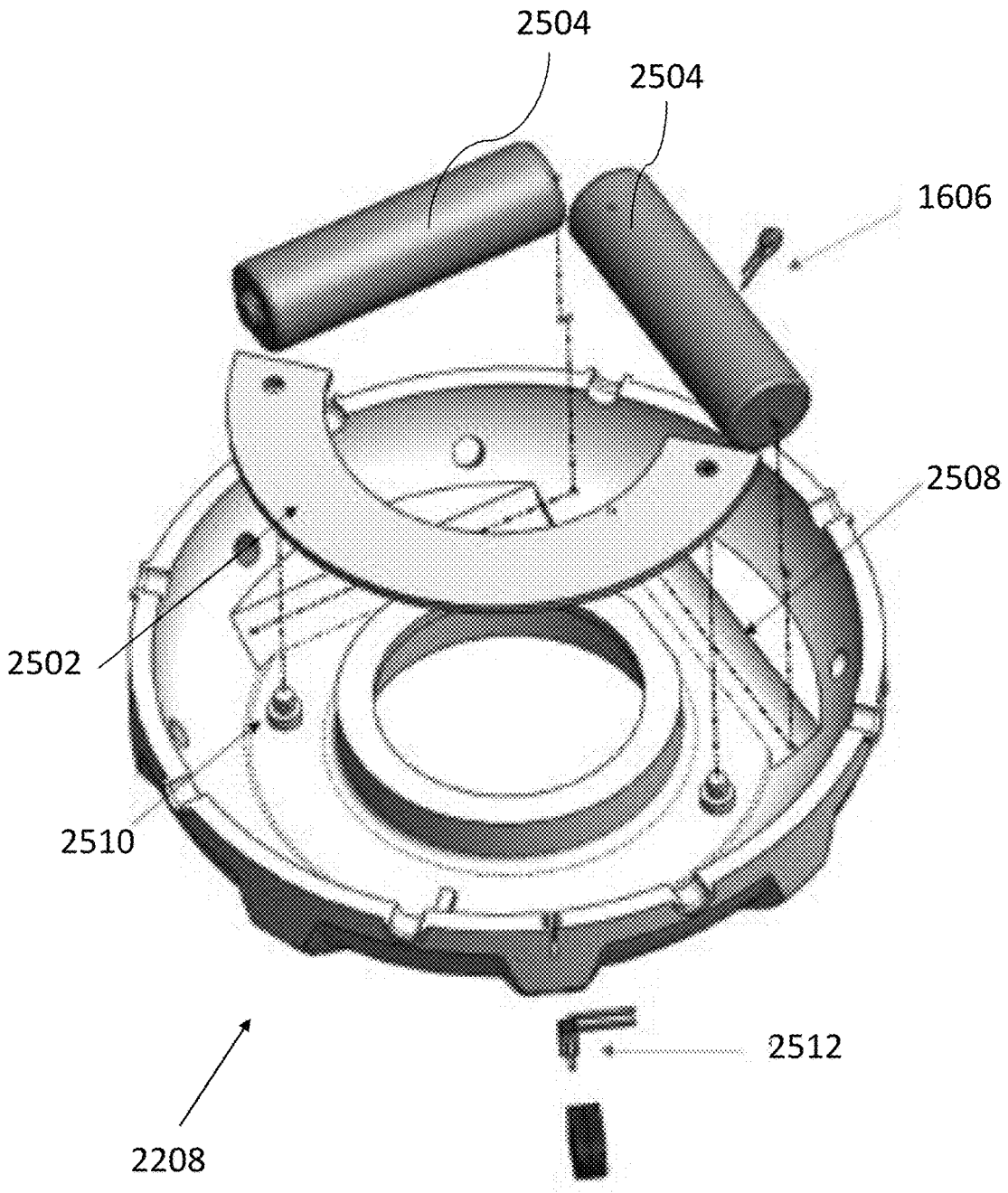
FIG. 25 illustrates an isometric top plane disassembled view of lower cover of an apparatus, in accordance with some demonstrative embodiments described herein.

Reference is now made to FIG. 25, which illustrates an isometric top plane disassembled view of lower cover 2208, according to some demonstrative embodiments.

As shown in FIG. 25, lower cover 2208 may be configured to act as a housing for mechanical and/or electrical systems or elements of apparatus 1306 (FIG. 13).

According to some embodiments, lower cover 2208 may include one or more printed circuit boards (PCB) 2502, which may mechanically support and/or electrically connect electronic components using, e.g., conductive tracks, pads and/or other features etched from copper sheets laminated onto a non-conductive substrate.

According to some embodiments, PCB 2502 can be single sided (e.g., one copper layer), double sided (e.g., two copper layers) or multi-layer. PCB 2502 may contain additional components including for example, capacitors, resistors or active devices.

According to some embodiments, lower cover 2208 may include one or more PCB fixation pins 2510, to lock and/or position PCB 2502 in place. According to some embodiments, lower cover 2208 may include one or more batteries 2504. Batteries 2504 may act as energy sources for fixator 1906 (FIG. 19) to enable the heating wire of fixator 1906 to heat upon activation.

Batteries 2504 may include any suitable electrochemical cells that convert stored chemical energy into electrical energy, and may be selected from the group including: 4.5-volt (3R12) battery, a D Cell battery, a C cell battery, an AA cell battery, an AAA cell battery, an AAAA cell battery, an A23 battery, a 9-volt PP3 battery, CR2032 battery, LR44 battery and the like. According to some preferred embodiments of the invention, batteries 2504 may include at least one AA battery, preferably two AA batteries.

According to some demonstrative embodiments, apparatus 1306 (FIG. 13) may include one or more tabs (not shown in the figure) to prevent closure of an electrical circuit connected to batteries 2504, for example, to prevent the unwanted use or drainage of energy from batteries 2504. According to these embodiments, only after the tab is removed by a user, apparatus 1306 (FIG. 13) is at a standby mode, and can become active.

According to some embodiments, batteries 2504 may be positioned in housing 2508.

According to some embodiments, lower cover 2208 may include one or detector 1606.

According to some demonstrative embodiments, detector 1606 may be any suitable electronic or mechanical device, configured to sense and/or identify the existence of any suitable indicator of a fire, including for example, elevated temperature, smoke, elevated $CO_2$ levels and the like. For example, detector 1606 may be selected from a group including: temperature detectors, e.g., configured to detect the elevation of temperature such as EN54-5; flame detectors, e.g., optical type detectors such as Ultraviolet flame detectors, Near infrared (IR) Array flame detectors, infrared flame detectors, UV and IR flame detectors, IR/IR flame detectors, IR3 flame detectors; Ionization current flame detectors; Thermocouple flame detectors; smoke detectors, such as Air-sampling detectors, Carbon monoxide and/or carbon dioxide detectors, Ionization detectors, Photoelectric detectors, Beam operated detectors, Aspirating detectors, Laser detectors, EN54-7 detectors and the like.

According to some embodiments, lower cover 2208 may include at least one covered safety catch 2512. According to some embodiments, covered safety catch 2512 may be a short length conductor used to close a break in, or bypass part of, an electrical circuit (also known as "a jumper"). The use of covered safety catch 2512 may prevent the undesired activation of apparatus 1306, and enable a user of fire extinguisher 1300 (FIG. 13) to use the device as a grenade, e.g., with a timing mechanism before it is automatically activated.

For example, a user of the fire extinguisher of the present invention, may remove a cap covering safety catch 2512 and accordingly initiate a countdown, wherein apparatus 1306 will be activated when the countdown finishes. According to these embodiments, upon removing the cap from covered safety catch 2512 the user will throw the fire extinguisher into a fire and accordingly ensure the operation of the fire extinguisher.

According to some other demonstrative embodiments, the fire extinguisher of the present invention may have other forms and/or types of safety catches besides safety catch 2512, for example, as described below with respect to FIGS. 26 and 27.

Figure 26:
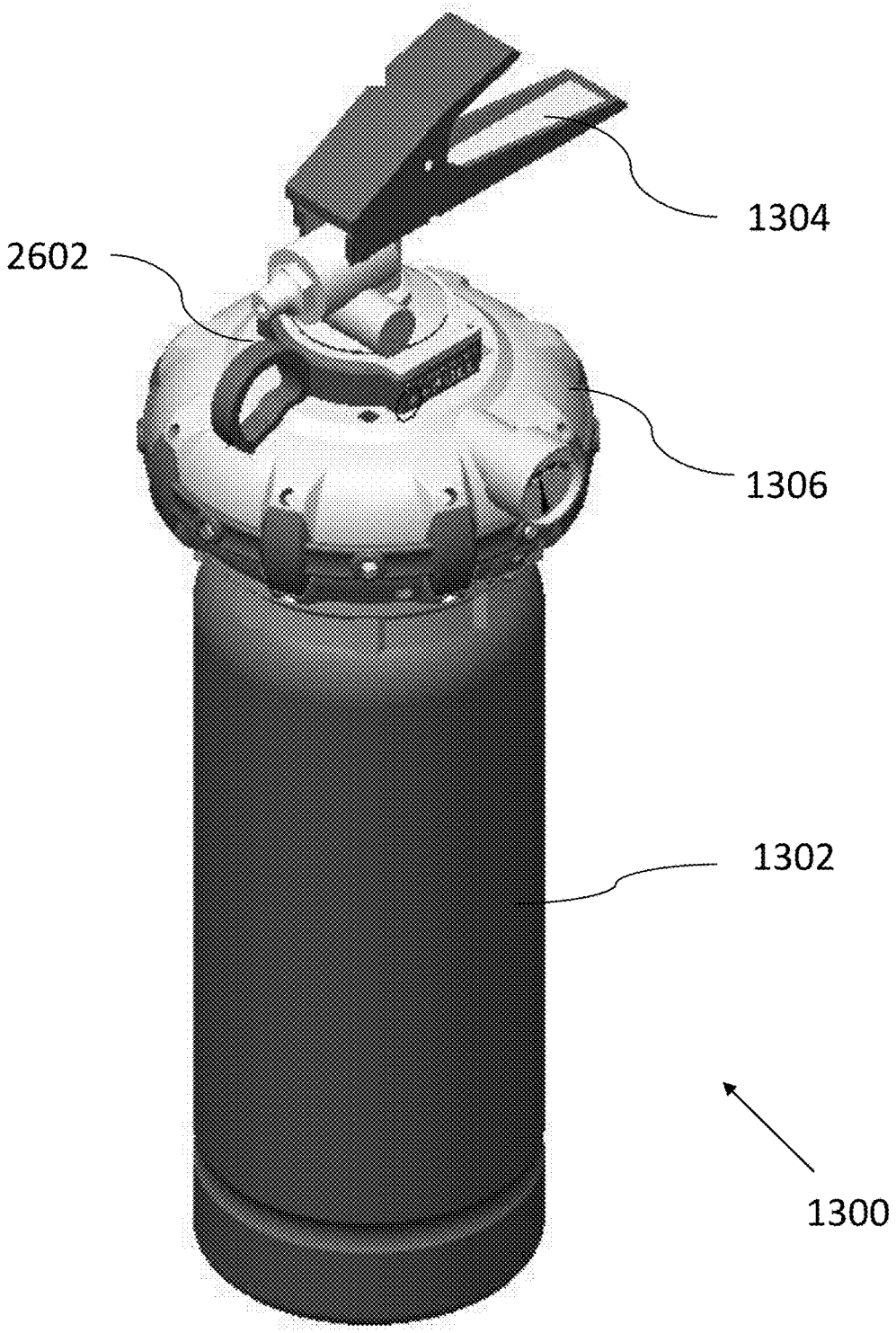
FIG. 26 illustrates an isometric view of a fire extinguisher in accordance with some demonstrative embodiments described herein.

Reference is now made to FIG. 26, which illustrates an isometric view of a fire extinguisher 1300 in accordance with some demonstrative embodiments described herein. According to some demonstrative embodiments, apparatus 1306 may include at least one removable safety catch 2602.

According to some embodiments, removable safety catch 2602 may be used to close a break in, or bypass part of, an electrical circuit. The use of removable safety catch 2602 may prevent the undesired activation of apparatus 1306, and enable a user of fire extinguisher 1300 to use the device as a grenade, e.g., with a timing mechanism before it is automatically activated.

Figure 27:
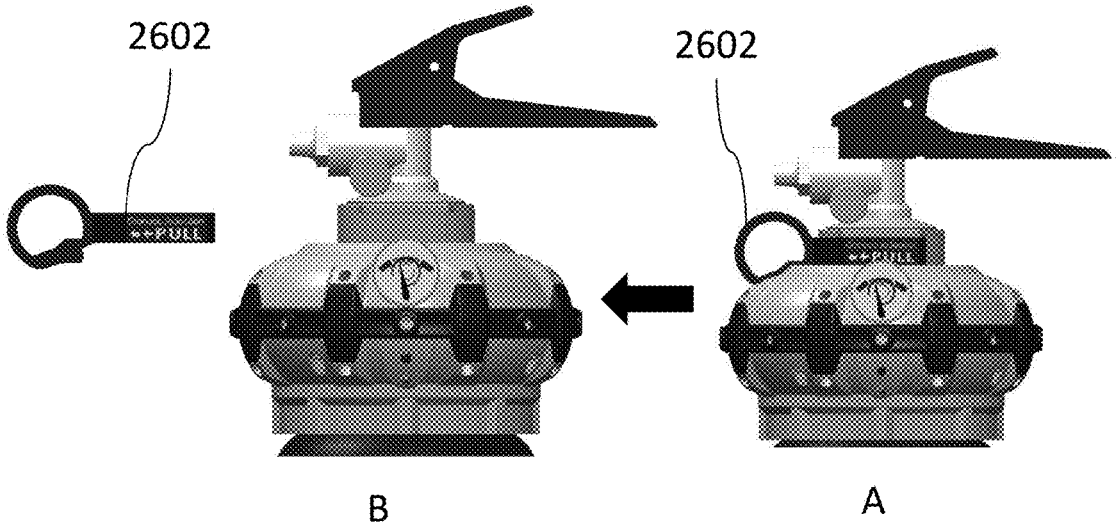
FIGS. 27A and 27B, respectively illustrate a first, inactive state, and a second, active state, of an apparatus according to some demonstrative embodiments described herein.

For example, a user of fire extinguisher 1300, may pull out removable safety catch 2602, e.g., as demonstrated in FIG. 27, and accordingly initiate a countdown, wherein apparatus 1306 will be activated when the countdown finishes. According to these embodiments, upon pulling out removable safety catch 2602 user of fire extinguisher 1300 will throw fire extinguisher 1300 into a fire and accordingly ensure the operation of fire extinguisher 1300.

For example, according to some demonstrative embodiments, apparatus 1306 may be operated as follows:

removable safety catch 2602 is removed by a user of fire extinguisher 1300 in order to activate an electrical circuit connected to the batteries.

At this stage apparatus 1306 is in standby mode.

If environmental temperature (monitored by a detector of apparatus 1306) reaches a first minimum temperature, e.g., 80° C., a buzzer is operated, to inform a user about extreme temperature change. According to some embodiments, the minimum temperature can be predetermined by changing electrical components of apparatus 1306. The user may also disable the buzzer function.

If environmental temperature (monitored by the detector of apparatus 1306) reaches a second minimum temperature, e.g., 110° C., apparatus 1306 is activated (e.g., wherein the wire of the fixator is heated, the string is torn and the fire extinguishing agent is released from fire extinguisher 1300).

Another optional method of operating fire extinguisher 1300 is to pull out removable safety catch 2602, consequentially causing a countdown mechanism to operate (for example, counting down 10 seconds). At the end of the countdown apparatus 1306 is activated (e.g., wherein the wire of the fixator of apparatus 1306 is heated, the string is torn and the fire extinguishing agent is released from fire extinguisher 1300.)

According to some embodiments, if the environmental temperature reaches the second minimum temperature, e.g., 110° C., apparatus 1306 is activated (wherein the wire of the fixator is heated, the string is torn and the fire extinguishing agent is released from fire extinguisher 1300, without a countdown).

Reference is now made to FIG. 27A, which is a schematic illustration of a first inactive state of an apparatus according to some demonstrative embodiments described herein. In FIG. 27A removable safety catch 2602 is attached to the apparatus of the present invention.

FIG. 27B is a schematic illustration of second active state of the apparatus according to some demonstrative embodiments described herein. In FIG. 27B removable safety catch 2602 is detached from apparatus of the present invention, e.g., by pulling removable safety catch 2602. According to some embodiments, when removable safety catch 2602 is pulled out an automatic countdown mechanism is activated and when the countdown finishes, the apparatus is activated, thereby releasing the fire extinguishing agent contained within the fire extinguisher of the present invention.

Figure 28:
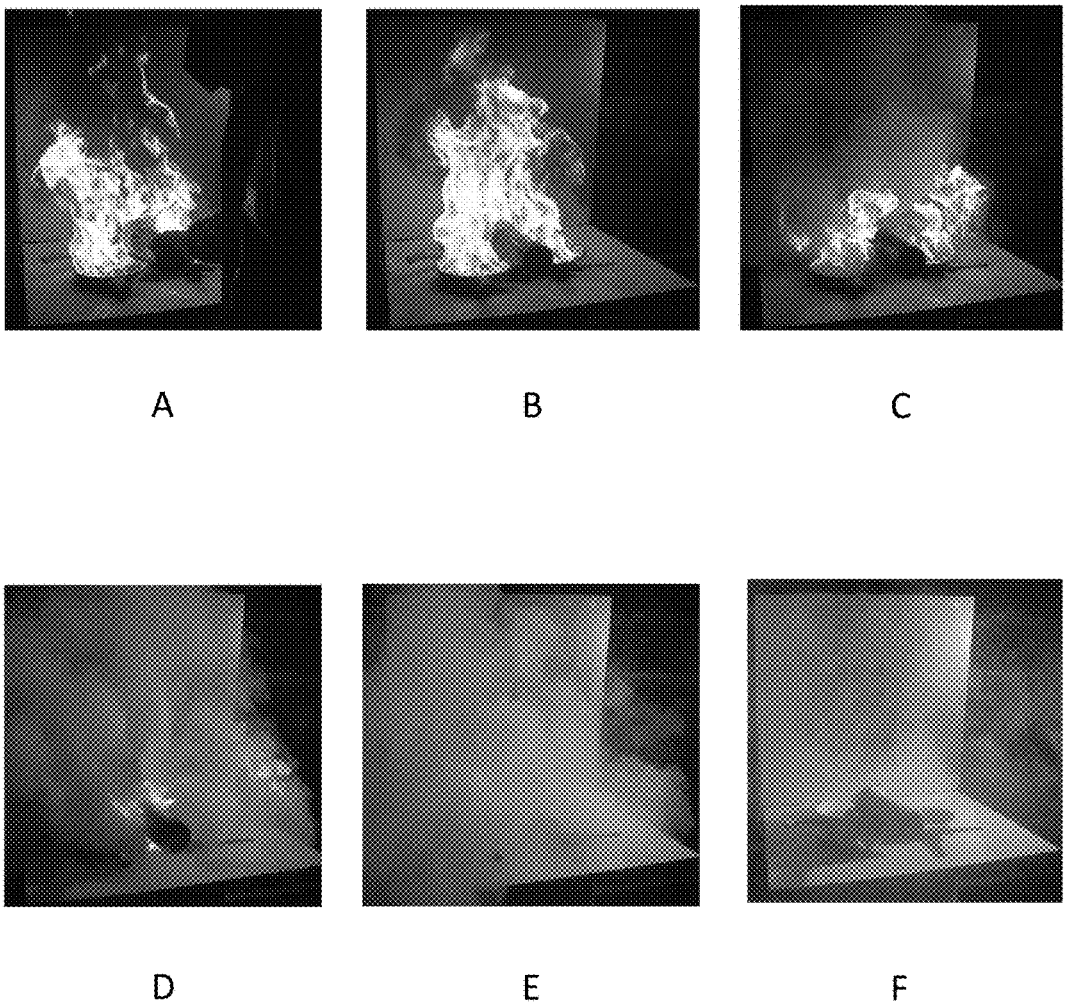
FIGS. 28 and 29 depict photos taken at different stages of an experiment demonstrating the use of the fire extinguisher of the present invention, in accordance with some demonstrative embodiments described herein.
Figure 29:
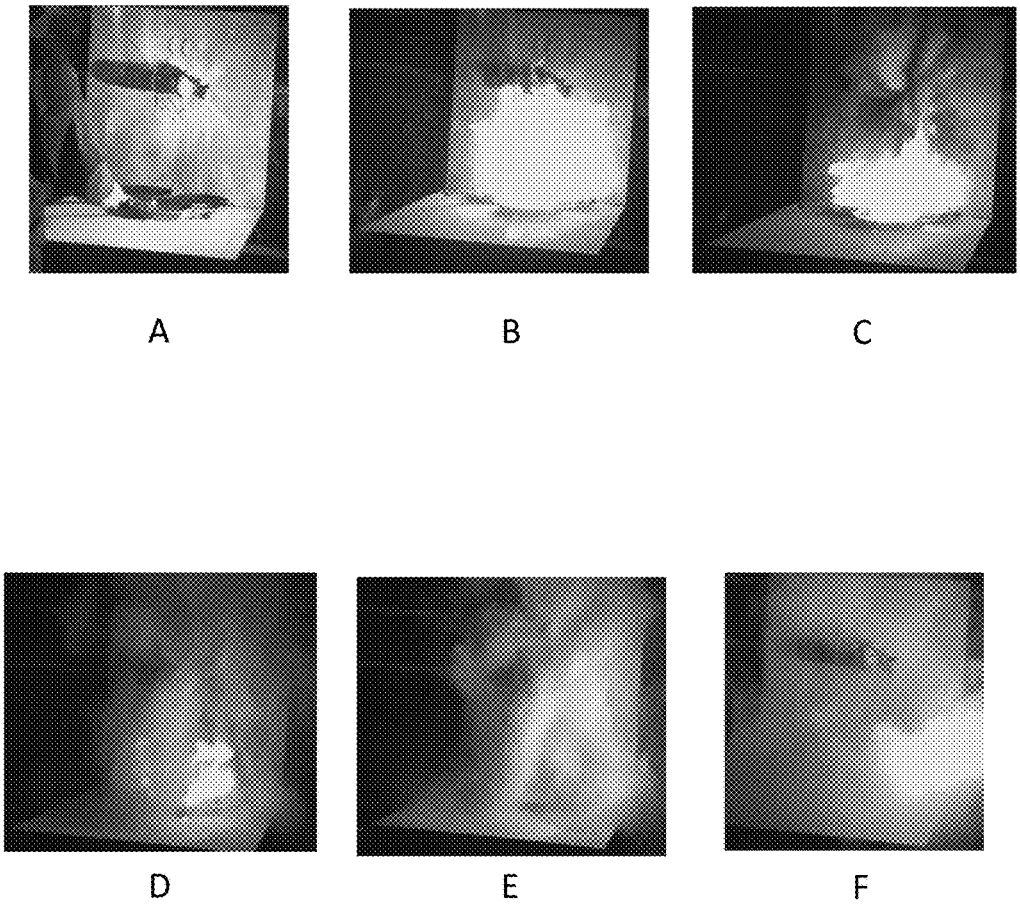

Reference is now made to FIGS. 28 and 29 which depict photos taken at different stages of an experiment demonstrating the use of the fire extinguisher of the present invention, in accordance with some demonstrative embodiments described herein.

In FIG. 28, the fire extinguisher of the present invention is thrown into a fire (with spread dimensions covering a surface area of around 2000 $cm^2$). According to some demonstrative embodiments, the fire extinguisher may even put out a fire with spread dimensions covering a surface area of up to 5000 $cm^2$.

FIG. 28A depicts a fire extinguisher of the present invention being thrown into the fire. FIG. 28B depicts the estimated moment in which a detector of the fire extinguisher detects the existence of a fire. FIG. 28C depicts the estimated moment in which the automatic system of the fire extinguisher is activated. FIG. 28D depicts the estimated moment in which a fire extinguishing agent is automatically released from the fire extinguisher, i.e., the stage of fire suffocation. FIG. 28E depicts the estimated moment in which the flames are put out. FIG. 28F depicts remains after the fire has been put out by the fire extinguisher.

In FIG. 29, the fire extinguisher of the present invention is positioned upon a wall, e.g., in a "sprinkler-like" position.

FIG. 29A depicts the moment in which a fire is lit (in this experiment, spread dimensions covering a surface area of around 2500 $cm^2$ were tested). However, according to some demonstrative embodiments, the fire extinguisher may even put out a fire with spread dimensions covering a surface area of up to 5000 $cm^2$, preferably with spread dimensions covering a surface area of up to 3900 $cm^2$.

FIG. 29B depicts the estimated moment in which a detector of the fire extinguisher detects the existence of a fire. FIG. 29C depicts the estimated moment in which the automatic system of the fire extinguisher is activated and a fire extinguishing agent is released from the fire extinguisher. FIG. 29D depicts the estimated moment in which the fire is suppressed. FIG. 29E depicts the estimated moment in which the flames are put out. FIG. 29F depicts remains after the fire has been put out by the fire extinguisher in the "sprinkler-like" position.

While this invention has been described in terms of some specific examples, many modifications and variations are possible. It is therefore understood that within the scope of the appended claims, the invention may be realized otherwise than as specifically described.

The invention claimed is:

1. A fire extinguisher comprising:

a nozzle;

a body;

a fire extinguishing agent in the body an apparatus comprising holes which are evenly spread throughout a surface of said apparatus to enable the equal spread of the fire extinguishing material from the fire extinguisher around the fire extinguisher:

wherein said apparatus is positioned between the nozzle and the body;

a first mechanism to operate said fire extinguisher via a manual operation through the nozzle;

a second mechanism to operate said fire extinguisher automatically through the holes;

wherein the second mechanism comprises:

at least one detector to enable the automatic detection of a fire;

a stopper to prevent the dispersion of the fire extinguishing agent from the fire extinguisher when the fire extinguisher is not operating automatically;

a heat sensitive member that breaks and releases the stopper; and wherein said at least one detector communicates with said heat sensitive member and upon detection of a fire causes the heat sensitive member to break and release said stopper.

2. The fire extinguisher of claim 1, wherein said at least one detector is configured to measure one or more environmental parameters to detect the existence of a fire, wherein said one or more environmental parameters is selected from a group including environmental temperature, environmental levels of Carbon Dioxide or Carbon Monoxide and existence of smoke.

3. The fire extinguisher of claim 1, wherein the fire extinguisher is configured to operate in one of the following modes of operation: an automatic "Sprinkler mode " operation, fire extinguishing grenade operation or a manual operation.

4. The fire extinguisher of claim 1, wherein said second mechanism further comprises a rod to keep the stopper in place connecting the stopper and the heat sensitive member;

a spring to push the rod and release the stopper when the fire extinguisher is operating automatically; and wherein the heat sensitive member comprises a string.

5. The fire extinguisher of claim 4, wherein said heat sensitive member further comprises at least one string tearing mechanism, configured to tear said at least one string and cause the release of said stopper.

6. The fire extinguisher of claim 1, wherein said detector is selected from a group including: temperature detector, EN54-5 detector, flame detectors, optical type detectors, Ultraviolet flame detectors, Near infrared (IR) Array flame detectors, infrared flame detectors, UV and IR flame detectors, IR/IR flame detectors, IR3 flame detectors; Ionization current flame detectors; Thermocouple flame detectors; smoke detectors, Air-sampling detectors, Carbon monoxide and/or carbon dioxide detectors, Ionization detectors, Photoelectric detectors, Beam operated detectors, Aspirating detectors, Laser detectors and EN54-7 detectors.

7. The fire extinguisher of claim 6, wherein said temperature detector is configured to sense the elevation of temperature beyond a predetermined temperature.

8. A method of extinguishing a fire by throwing the fire extinguisher of claim 1 into a fire.

9. The method of claim 8, further comprising pulling out a removable safety catch before throwing said fire extinguisher into said fire, wherein pulling out said safety catch causes operation of a countdown timer and consecutively the operation of said fire extinguisher.

* * * * *